US012435923B2

(12) United States Patent
Fienup

(10) Patent No.: US 12,435,923 B2
(45) Date of Patent: Oct. 7, 2025

(54) BEVERAGE CAN COOLER

(71) Applicant: MechEnvent LLC, Chicago, IL (US)

(72) Inventor: William James Fienup, Chicago, IL (US)

( * ) Notice: Subject to any disclaimer, the term of this patent is extended or adjusted under 35 U.S.C. 154(b) by 245 days.

(21) Appl. No.: 17/929,333

(22) Filed: Sep. 2, 2022

(65) Prior Publication Data

US 2022/0412648 A1 Dec. 29, 2022

Related U.S. Application Data

(63) Continuation-in-part of application No. 17/115,893, filed on Dec. 9, 2020, now abandoned, and a continuation-in-part of application No. 16/873,247, filed on Mar. 4, 2020, now abandoned.

(51) Int. Cl.

| | |
|---|---|
| ***F25D 31/00*** | (2006.01) |
| ***F25D 3/08*** | (2006.01) |
| ***F28D 21/00*** | (2006.01) |
| ***F28F 1/20*** | (2006.01) |

(52) U.S. Cl.

CPC ..... *F25D 31/007* (2013.01); *F25D 3/08* (2013.01); *F28F 1/20* (2013.01); *F25D 2331/805* (2013.01); *F25D 2331/809* (2013.01); *F28D 2021/0029* (2013.01); *F28D 2021/0042* (2013.01)

(58) Field of Classification Search

CPC .... F25D 3/08; F25D 2331/805; F25D 31/006; F25D 31/007; F25D 2303/0841; F25D 2331/0841; F25D 2331/809

See application file for complete search history.

(56) References Cited

U.S. PATENT DOCUMENTS

| | | | | |
|---|---|---|---|---|
| 3,302,427 | A | 2/1967 | Stoner et al. | |
| 4,293,015 | A | 10/1981 | McGough | |
| 4,638,645 | A * | 1/1987 | Simila | F25D 31/007 62/529 |
| 4,745,776 | A | 5/1988 | Clark | |
| 4,793,149 | A | 12/1988 | Riche | |
| 4,870,837 | A * | 10/1989 | Weins | F25D 31/007 215/394 |

(Continued)

FOREIGN PATENT DOCUMENTS

| | | | | |
|---|---|---|---|---|
| JP | 07270018 A | * | 10/1995 | F25D 3/08 |
| JP | 2003325357 A | * | 11/2003 | |

OTHER PUBLICATIONS

Chill Puck available from Chill Promotions, 3525 Oleander Avenue Alameda, California 94502.

(Continued)

*Primary Examiner* — Nelson J Nieves

(74) *Attorney, Agent, or Firm* — Paul E Schaafsma; NovusIP, LLC

(57) ABSTRACT

In accordance with the principals of the present invention, a cold tube is adapted to securely surround the beverage can, the cold tube utilizing high heat capacity/thermal mass to wick heat from the beverage in the beverage can. Contained within the cold tube, a plurality of fins are provided thus acting as a heatsink. The presence of the fins act as a heatsink by increasing convective, conductive, and radiative heat dissipation if used in the absence of the cold tube and conductive heat dissipation if used with the cold tube.

16 Claims, 22 Drawing Sheets

(56) References Cited

U.S. PATENT DOCUMENTS 5,000,331 A * 3/1991 Conlon ..... B65D 23/001 422/561
5,048,307 A * 9/1991 Baxter ..... F25D 3/08 62/518
5,207,076 A * 5/1993 Sciarrillo ..... B65D 81/3883 62/530
5,269,368 A * 12/1993 Schneider ..... B65D 81/3883 62/530
5,377,495 A * 1/1995 Daigle ..... F25B 45/00 62/149
6,065,300 A * 5/2000 Anthony ..... F25D 3/107 29/455.1
6,082,114 A * 7/2000 Leonoff ..... B60H 1/00592 62/457.4
6,141,969 A * 11/2000 Launchbury ..... B60N 3/104 62/3.4
6,168,043 B1 * 1/2001 Yen ..... A47G 23/0241 220/501
6,330,808 B1 * 12/2001 Kouwenberg ..... F25D 31/007 62/530
6,705,110 B1 * 3/2004 Worsham ..... F25D 31/007 62/530
8,251,247 B1 * 8/2012 Breckner ..... A47G 23/0241 220/592.16
8,534,345 B1 * 9/2013 French ..... A47J 41/0083 165/10
9,448,006 B2 * 9/2016 Kulkarni ..... F25D 31/007
10,730,362 B2 8/2020 Tilbury
2011/0042549 A1 2/2011 Schiro
2015/0267961 A1 * 9/2015 Christian ..... F25D 31/008 220/592.17
2016/0069608 A1 * 3/2016 Afolabi ..... F25D 5/02 62/457.3
2016/0209112 A1 * 7/2016 Bayless ..... F25D 7/00
2016/0236605 A1 * 8/2016 Doi ..... F25D 31/007
2016/0282020 A1 9/2016 Valdes et al.
2017/0363341 A1 * 12/2017 Nguyen ..... F25D 3/08
2018/0087821 A1 3/2018 McGirl
2018/0259236 A1 * 9/2018 Anthony ..... F25D 31/007
2020/0008316 A1 1/2020 Cola et al.
2021/0239388 A1 * 8/2021 Rothe ..... F25D 25/005

OTHER PUBLICATIONS

Cooper Cooler Rapid Beverage & Wine Chiller available from RCS, Inc., 47 Overocker Road, Poughkeepsie, New York 12603.
InnoChiller available from InnoChiller ApS, Havnegade 37 E 1. tv., 6700 Esbjerg, Denmark.
Spin Chill was designed by ApexTek Labs 710 South Main Street, Gainesville Florida 32601.

* cited by examiner

BEVERAGE CAN COOLER

CROSS-REFERENCE TO RELATED APPLICATIONS

This continuation-in-part utility patent application claims the benefit of and priority to U.S. patent application Ser. No. 17/115,893, filed 9 Dec. 2020, which is a continuation-in-part utility patent application of U.S. patent application Ser. No. 16/873,247, filed 4 Mar. 2020, both entitled "Beverage Can Cooler", the contents of both of which are hereby incorporated by this reference.

FIELD OF THE INVENTION

The present invention relates to beverage cooling.

BACKGROUND OF THE INVENTION

Many beverages, including beer, soft drinks, wines, and the like are not only packaged in cans but can also be consumed directly from the can. Such beverage cans are typically cooled by placing them in a refrigerator prior to consumption; several devices exist to maintain the cool temperature of the beverage once it is removed from the refrigerator for consumption, the most common being an insulator that surrounds the can during consumption.

Variously referred to a beer cozy, beer jacket or drink huggie, the koozie can be rigid or soft and flexible. It is believed that the original version of the koozie was introduced in Australia in the 1970s. In 1980, a woman named Bonnie McGough filed a patent application for an "insulated drink cozy" with insulating material sandwiched by outer fabric, which application resulted in U.S. Pat. No. 4,293,015 issued 6 Oct. 1981.

In 2013, a team at the University of Washington put together an experiment to discover if koozies actually work. The study attracted grant funding from the National Center for Atmospheric Research and the National Science Foundation. The study concluded that koozies help to prevent canned drinks from warming up by preventing condensation from forming on the can. Dale Durran and Dargan Frierson, "Condensation, Atmospheric Motion, and Cold Beer", 66 Physics Today 4, 74 (2013) (Available at https://physicstoday. scitation.org/doi/10.1063/PT.3.1958? journalCode=pto (accessed 11 Feb. 2020)).

While koozies help maintain the cold temperature after the beverage has been cooled, however, it is often desirable to cool a room temperature can and drink its contents on short notice, without having to wait several hours for refrigeration to cool the beverage. Perhaps the initial attempt to address this was the addition of fluids into the walls of koozies, which fluids can be frozen prior to use. A recent variant of this is the Chill Puck available from Chill Promotions, 3525 Oleander Avenue Alameda, California 94502. The Chill Puck relies upon conduction via a plastic encapsulated gel that clips on to the bottom of a can. While perhaps helping maintain a cold temperature, the Chill Puck simply does not provide for sufficient heat transfer to achieve the quick cooling of room temperature beverages.

Thus, there exists a need to conveniently quickly cool down a beverage in a can from room temperature to a desirable drinking temperature. Currently there are many cumbersome methods to accomplish this task. The most common method simply involves placing the can(s) is a container filled with ice/ice water, such as an ice bucket. This method is often supplemented by rotation the can in the ice/ice water bath. There are also expensive commercial appliances that need to chill several cups of water before they are ready to cool a beverage. There are also other apparatus which require the beverage to be transferred to another vessel and a subset of those that require an additional transfer to another glass. All these separate vessels require cleaning.

For example, beyond ice buckets there also exist so-called high-performance ice packs, which rely on conduction via half ice blocks shaped to partially surround cans. While inexpensive and capable of keeping beverages cool on the go—with a concave shape walls designed to cradle the can—these ice packs exhibit poor heat transfer properties as a layer of insulating plastic separate the frozen ice from the can and thus achieve little in cooling room temperature cans.

A crude attempt to cool down a beverage in a can utilizes a common drill with a specialized drill bit, such as the Spin Chill, which utilizes conduction and forced internal convection by spinning the can in a tub of ice. The Spin Chill was designed by ApexTek Labs 710 South Main Street, Gainesville Florida 32601. This approach works, but requires use of a drill and a bucket or other source of ice/ice water.

One such commercially available attempt is the InnoChiller available from InnoChiller ApS, Havnegade 37 E 1. tv., 6700 Esbjerg, Denmark. The InnoChiller uses forced convection to create the "wind chill" effect, claiming to speed up the energy exchange by creating a high velocity air speed inside a compartment that holds the cans from a fan installed in the back end of the unit when in the freezer. This unit, however, is quite expensive, requires frequent charging to power the fan, and runs the risk of over chilling or freezing the beverage when in the freezer.

Another commercially available attempt is the Cooper Cooler Rapid Beverage & Wine Chiller available from RCS, Inc., 47 Overocker Road, Poughkeepsie, New York 12603. The Cooper Cooler Rapid Beverage & Wine Chiller utilizes conduction with chilled water and spinning agitation. This unit, however, likewise is quite expensive, requires a constant power, and requires an initial set-up time to "power up".

Still other apparatuses require the beverage to be transferred to another vessel and a subset of those that require an additional transfer to another glass. All these separate vessels require cleaning.

Thus, what would be beneficial would be an inexpensive, convenient, and economical way of quickly cooling room temperature beverages in can to a cold consumption temperature while avoiding the risk of over chilling or freezing the beverage.

SUMMARY OF THE INVENTION

This Summary of the Invention is provided to introduce a selection of concepts in a simplified form that are further described below in the Detailed Description section. This Summary of the Invention is not intended to identify key features or essential features of the claimed subject matter, nor is it intended to be used as an aid in determining the scope or spirit of the claimed subject matter.

A beverage can cooler in accordance with the principals of the present invention presents an inexpensive, convenient, and economical way of quickly cooling room temperature beverages in a beverage can to a cold consumption temperature while avoiding the risk of over chilling or freezing the beverage. In accordance with the principals of the present invention, a cold tube is adapted to securely surround the beverage can, the cold tube utilizing high heat capacity/thermal mass to wick heat from the beverage in the can. Contained within the cold tube, a plurality of fins act as a heatsink; in an alternative aspect in accordance with the principles of the present invention, the heatsink could be utilized alone, in the absence of the cold tube. The presence of the fins act as a heatsink by increasing convective, conductive, and radiative heat dissipation if used without the working mass and conductive heat dissipation if used with the working mass. The working mass can be a solid, liquid, gas, gel, or phase transition material. Thus, the fins reduce need for high thermal heat capacity of previous designs.

The heatsink should be in close proximal connection with the beverage can. In one aspect in accordance with the principals of the present invention, the heatsink can comprise at least a split design, allowing the heatsink to expand around the beverage can and achieve sufficient contact pressure/surface area for condition between the two elements conducting thermal transfer.

In one aspect in accordance with the principals of the present invention, the heatsink can be confined in an integral outer tube, the integral outer tube containing the working mass, and the working mass and heatsink cooled. In another aspect in accordance with the principals of the present invention, the heatsink can be placed in a mold, the mold filled with water as the working mass, and the water and heatsink frozen. The conductive heatsink helps dissipate the heat into the high thermal working mass. The working mass also allows the device to function in a non-subzero environment and can eliminate the risk of freezing the beverage.

This Summary of the Invention introduces concepts in a simplified form that are further described below in the Detailed Description. This Summary of the Invention is not intended to identify key features or essential features of the claimed subject matter, nor is it intended to be used as an aid in determining the scope of the claimed subject matter.

BRIEF DESCRIPTION OF THE DRAWINGS

The accompanying Drawings illustrate several embodiments and, together with the description, serve to explain the principles of the present invention according to the example embodiments. It will be appreciated by one skilled in the art that the particular arrangements illustrated in and described with respect to the Drawings are merely exemplary and are not to be considered as limiting of the scope or spirit of the present invention or the claims herein in any way.

Figure 1A:
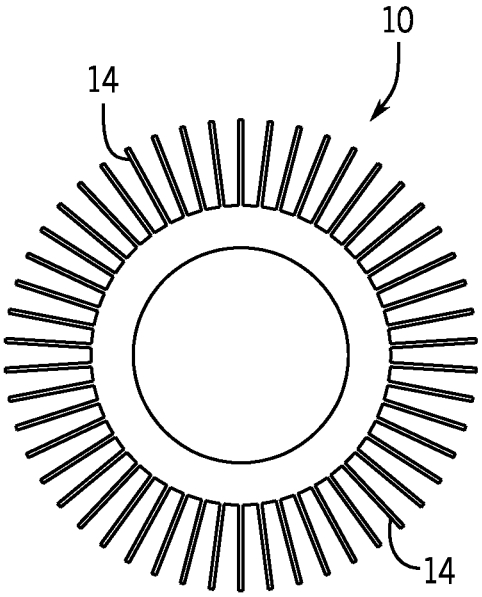
FIG. 1A is a diagram of a top view of a cold tube adapted to securely surround a beverage can, according to an example embodiment in accordance with the principals of the present invention.

As noted above, in the above reference Drawings, the present invention is illustrated by way of example, not limitation, and modifications may be made to the elements illustrated therein, as would be apparent to a person of ordinary skill in the art, without departing from the scope or spirit of the invention.

DETAILED DESCRIPTION OF THE INVENTION

Introduction

As previously described, there is a need to conveniently and quickly cool down a beverage from room temperature to a desirable drinking temperature. Currently there are many cumbersome methods to accomplish this task. Some require filling a large vessel with ice and water and others are a bit more elaborate and involve rotating a beverage in cold water: a popular do-it-yourself method attaches a beverage to a drill and spins the beverage can in salted ice water, which has evolved into specialized drill bits designed for this purpose. There are also expensive commercial appliances that need to chill several cups of liquid before they are ready to cool a beverage. Other apparatus requires the beverage to be transferred to another vessel and a subset of those that require an additional transfer to another glass. All these separate vessels require cleaning.

In accordance with the principals of the present invention, a beverage can cooler is provided that provides a low cost, convenient, and economical way of quickly cooling room temperature beverages in a can to a cold consumption temperature while avoiding the risk of over chilling or freezing the beverage. In accordance with the principals of the present invention, a cold tube is adapted to securely surround the beverage can, the cold tube utilizing high heat capacity/thermal mass to wick heat from the beverage in the can. Contained within the cold tube, a plurality of fins act as a heatsink. The presence of the fins act as a heatsink by increasing convective, conductive, and radiative heat dissipation if used without a working mass and conductive heat dissipation if used with the working mass. Thus, the fins reduce need for high thermal heat capacity of previous designs.

The heatsink should be in close proximal connection with the beverage can. In an aspect in accordance with the principals of the present invention, the heatsink can comprise a split design utilizing two or more halves, allowing the heatsink to expand around the beverage can and achieve sufficient contact pressure/surface area for condition between the two elements conducting thermal transfer. In an aspect in accordance with the principals of the present invention, the multiple sections can be biased together with an elastic, rubber or spring band to apply pressure to the beverage can; in an alternative aspect in accordance with the principals of the present invention the split design can define a hinge and can be closed-biased with the hinge around the outer diameter of the beverage can. A preferred placement of the hinge can be about 180 degrees from a slot (directly across the diameter), but the hinge could be contained at other suboptimal locations. A hinge can be used to increase the clamping force in combination with a strap or clasp mechanism. In this aspect in accordance with the principals of the present invention, the heatsink can comprise a C-shaped design which combined with the natural pliability of the material enables the C-shaped heatsink to be expanded when placed on and to slightly contract around the beverage can, thus tightly "clamping" the heatsink around the beverage can.

The heatsink can be formed by extrusion and should be comprised on a material having good heat transfer capabilities, such as a conductive material like aluminum, copper, silver, gold, tungsten, diamond, cubic boron arsenide, graphite, and the like. The hinge can be a living hinge that can be extruded with the heatsink as part of a one-piece manufacturing process, with the living hinge providing the closed bias.

Thus, the high thermal conductive heatsink is able to expand and clamp around the diameter of the beverage can. It is helpful to maintain surface contact with the walls of the beverage can and allowing the heatsink to expand and contract helps accommodate manufacturing tolerances both for the heatsink and slight variation in beverage can diameters. Also, this clamping pressure lowers the thermal resistance between the two surfaces transferring thermal energy. A beverage can cooler in accordance with the principals of the present invention avoids use of a heatsink manufactured to a tight tolerance which would not be as effective in adjusting to different beverage can tolerances and cost more to manufacture.

One of the main challenges of the heatsink design of the present invention is that to achieve best performance a large temperature differential is desired. In ideal conditions, the environment that the heatsink is in is below the freezing point of liquids (0 degrees C.). In this environment, the device will chill a room temperature beverage in minutes; however, there is a risk of over chilling and freezing the beverage. An additional modification in accordance with the principals of the present invention prevents over chilling and freezing the beverage by adding an additional amount of working mass around the heatsink and removing it from the subzero environment. In this embodiment, the heatsink would be contained in an insulating vessel, working mass would be contained within or added around the heatsink, and then placed in a subzero environment to form a working-mass pocket around the heatsink. When there is a desire to cool a beverage, the device would be removed from the subzero environment and put into a refrigerator or room temperature environment. The working mass would continue to wick heat away from the heatsink, and the heatsink would wick heat away from the beverage until beverage was removed or the systems reached thermal equilibrium above the freezing point of the beverage. This reduces material cost, increases total thermal heat capacity, and eliminates the risk of freezing. This also uses conduction and a much quicker way to thermal transfer heat (vs convection or forced convection).

In another aspect in accordance with the principals of the present invention, the heatsink can be confined in an integral outer tube made from for example aluminum extruded with the heatsink as part of a one-piece manufacturing process which is capped on both ends to contain the working mass. The integral outer tube can be factory or user filled with the working mass. The working mass simply can be water, but can also be a material with antifreeze properties such as for example salt water such a saline solution, propylene glycol, ethylene glycol or other phase change materials. The working mass can be a liquid but could also be a gel or even nitrogen or helium or other ultra-cold gasses that are cooled to a liquid or solid state.

By using an alternative material (other than water) with a lower freezing point, the rate at which the beverage can cools can be sped up by increasing the temperature delta between the heatsink and the beverage can. The formula of the working mass can be calibrated to have a phase transition at a specific temperature by adjusting the concentration of salt or antifreeze in the solution. This can be important when cooling beverages that contain alcohol which freeze at lower temperatures because such phase transition maximizes the temperature differential with the working mass without creating and freezing condition. The heatsink increases the thermal transfer of the contents of the beverage to a cold mass of high heat capacity. The colder this thermal mass is the faster the thermal transfer takes place. The conductive heatsink helps dissipate the heat into the high thermal ice mass. The ice also allows the device to function in a non-subzero environment and can eliminate the risk of freezing the beverage. This cold mass can be stored in a freezer so that it is ready on demand.

In an alternative aspect in accordance with the principals of the present invention, the heatsink can be placed in a mold, filled with water as the working mass, and frozen to prepare the cold tube adapted to securely surround the beverage can for use. Ice is a low cost and readily available material to use as a working mass because a user can fill tap water around the heatsink at room temperature and put it in the freezer to create ice around the surface area of the heatsink. Ice has very high heat capacity and is inexpensive, but has low thermal conductivity.

By adding fin geometry, there is greater convection and radiation thermal transfer to the freezer. Utilizing a beverage can cooler in accordance with the principals of the present invention with the fins alone would work well if the beverage is chilled in a cold environment; whereas by utilizing a beverage can cooler in accordance with the principals of the present invention with working mass surrounding the heatsink, chilling in a room temperature or refrigerator environment reduces the risk of over chilling and freezing the beverage. The thermal heat capacity of the cold mass could be calibrated to only withdraw enough thermal energy so as to chill and not freeze the beverage. For the heatsink to be expandable with low force in this embodiment, it is preferred that the working mass is also split in at least two halves—or if the embodiment utilizes the hinge, thin at the point of the hinge so the ice can be easily broken—with one block on each side of the hinged or living hinged element.

Initial Considerations

Generally, one or more different embodiments may be described in the present application. Further, for one or more of the embodiments described herein, numerous alternative arrangements may be described; it should be appreciated that these are presented for illustrative purposes only and are not limiting of the embodiments contained herein or the claims presented herein in any way. One or more of the arrangements may be widely applicable to numerous embodiments, as may be readily apparent from the disclosure. In general, arrangements are described in sufficient detail to enable those skilled in the art to practice one or more of the embodiments, and it should be appreciated that other arrangements may be utilized and that structural, logical, software, electrical and other changes may be made without departing from the scope or spirit of the present invention. Particular features of one or more of the embodiments described herein may be described with reference to one or more particular embodiments or figures that form a part of the present invention, and in which are shown, by way of illustration, specific arrangements of one or more of the aspects. It should be appreciated, however, that such features are not limited to usage in the one or more particular embodiments or figures with reference to which they are described. The present disclosure is neither a literal description of all arrangements of one or more of the embodiments nor a listing of features of one or more of the embodiments that must be present in all arrangements.

Headings of sections provided in this patent application and the title of this patent application are for convenience only and are not to be taken as limiting the present invention in any way.

Devices and parts that are connected to or in communication with each other need not be in continuous connection or communication with each other, unless expressly specified otherwise. In addition, devices and parts that are connected to or in communication with each other may communicate directly or indirectly through one or more connection or communication means or intermediaries, logical or physical.

A description of an aspect with several components in connection or communication with each other does not imply that all such components are required. To the contrary, a variety of optional components may be described to illustrate a wide variety of possible embodiments and in order to more fully illustrate one or more embodiments. Similarly, although process steps, method steps or the like may be described in a sequential order, such processes and methods may generally be configured to work in alternate orders, unless specifically stated to the contrary. In other words, any sequence or order of steps that may be described in this patent application does not, in and of itself, indicate a requirement that the steps be performed in that order. The steps of described processes may be performed in any order practical. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to one or more of the embodiments, and does not imply that the illustrated process is preferred. Also, steps are generally described once per aspect, but this does not mean they must occur once, or that they may only occur once each time a process, or method is carried out or executed. Some steps may be omitted in some embodiments or some occurrences, or some steps may be executed more than once in a given aspect or occurrence.

When a single device or article is described herein, it will be readily apparent that more than one device or article may be used in place of a single device or article. Similarly, where more than one device or article is described herein, it will be readily apparent that a single device or article may be used in place of the more than one device or article.

The functionality or the features of a device may be alternatively embodied by one or more other devices that are not explicitly described as having such functionality or features. Thus, other embodiments need not include the device itself.

Techniques and mechanisms described or referenced herein will sometimes be described in singular form for clarity. However, it should be appreciated that particular embodiments may include multiple iterations of a technique or multiple instantiations of a mechanism unless noted otherwise. Process descriptions or blocks in figures should be understood as representing modules, segments, or steps in the process. Alternate implementations are included within the scope or spirit of various embodiments in which, for example, functions may be executed out of order from that shown or discussed, including substantially concurrently or in reverse order, depending on the functionality involved, as would be understood by those having ordinary skill in the art.

Conceptual Architecture

Figure 1B:
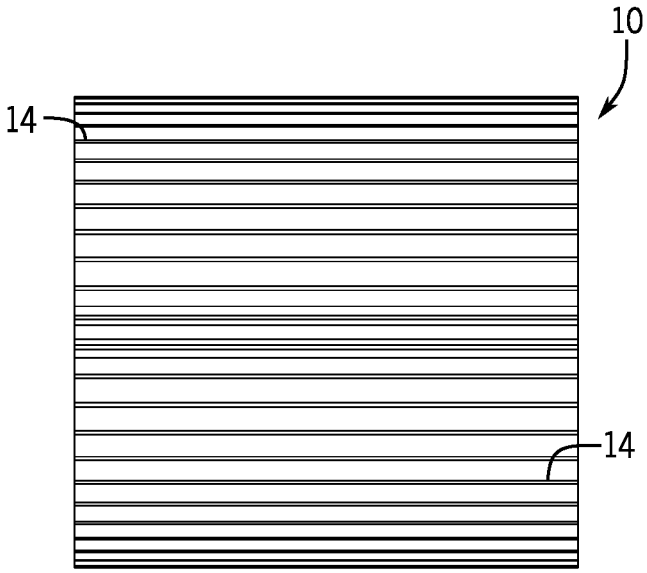
FIG. 1B is a cross-sectional side view of the cold tube of FIG. 1A.

In more detail and referring to FIG. 1, a diagram of a cold tube 10 adapted to securely surround a beverage can is seen, according to an example embodiment in accordance with the principals of the present invention: FIG. 1A shows a diagram of a top view looking downward on the cold tube 10; FIG. 1B shows a cross-sectional side view of the cold tube 10. The cold tube 10 is adapted to securely surround the beverage can and uses high heat capacity/thermal mass to wick heat from the beverage.

Figure 3:
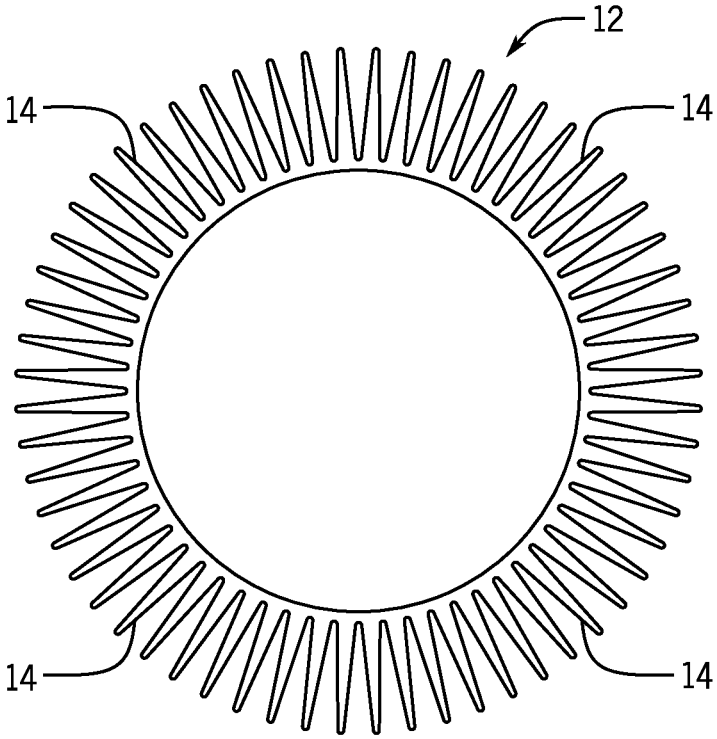
FIG. 3 is a top view of the heatsink of FIG. 2.
Figure 2:
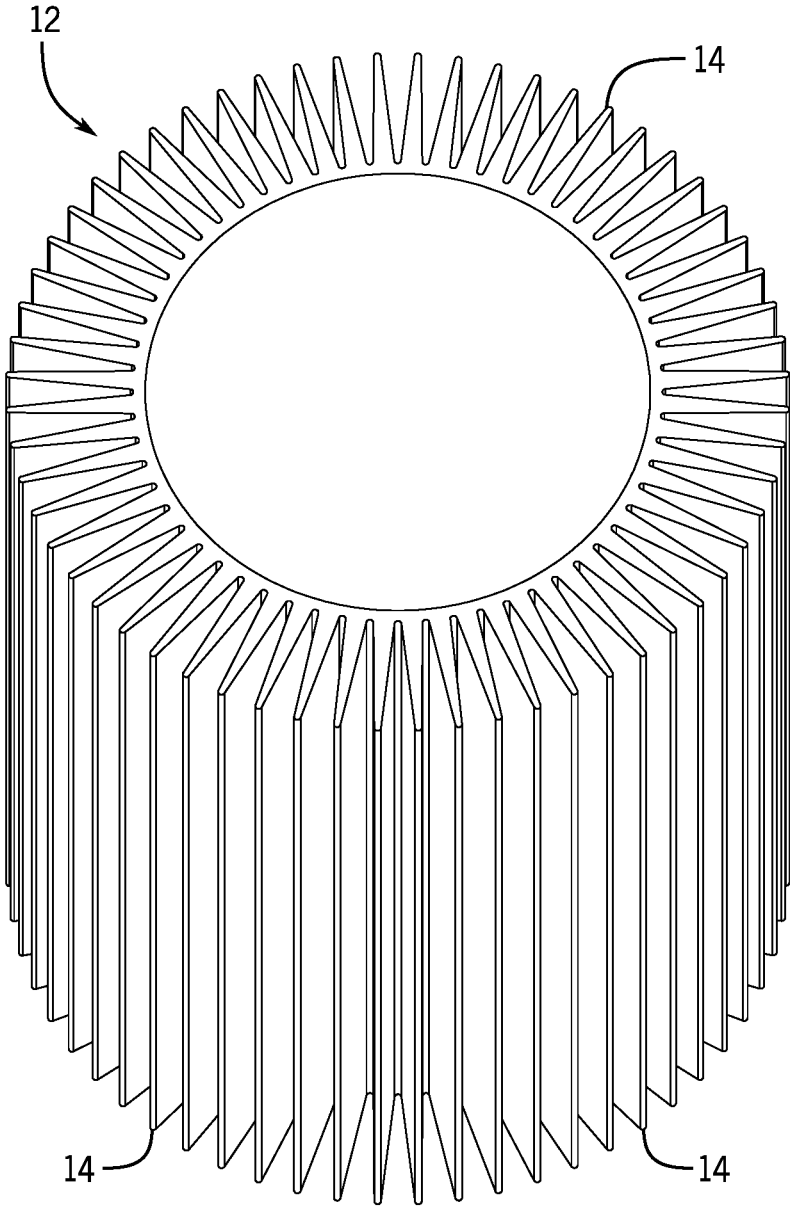
FIG. 2 is a perspective view of a heatsink to be contained within the cold tube of FIG. 1, according to an example embodiment in accordance with the principals of the present invention.

Contained within the cold tube 10 a plurality of fins 14 act as a heatsink 12. In an alternative aspect in accordance with the principles of the present invention, the heatsink 12 can be utilized alone, in the absence of the cold tube. The presence of the fins act as a heatsink by increasing convective, conductive, and radiative heat dissipation if used in the absence of the cold tube and conductive heat dissipation if used with the cold tube. Thus, the fins 14 reduce need for high thermal heat capacity. Referring to FIGS. 2 and 3, a heatsink 12 adapted to be contained within the cold tube 10 of FIG. 1 is seen, in according to an example embodiment in accordance with the principals of the present invention. The heatsink 12 should be in close proximal connection with the beverage can.

Figure 4:
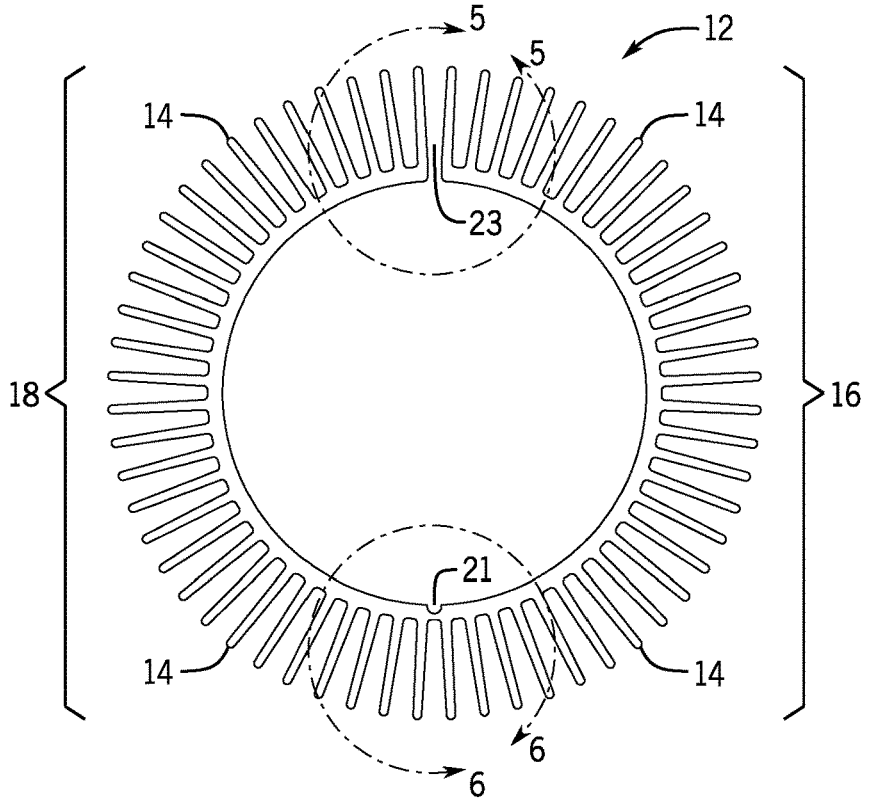
FIG. 4 is likewise a top view of a heatsink to be contained within the cold tube of FIG. 1, according to an additional example embodiment in accordance with the principals of the present invention.

FIG. 4 is a top view of one embodiment of a heatsink 12 adapted to be contained within the cold tube 10 of FIG. 1, according to an additional example embodiment in accordance with the principals of the present invention. In this aspect in accordance with the principals of the present invention, the heatsink 12 can comprise a split design comprising two halves 16, 18 and define a hinge 21, allowing the heatsink 12 to expand around the beverage can and achieve sufficient contact pressure/surface area for condition between the two elements conducting thermal transfer.

Figure 5:
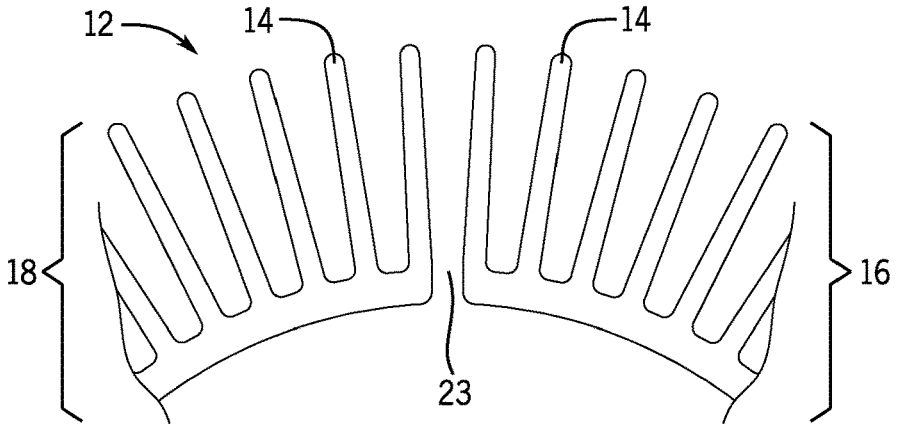
FIG. 5 is a close-up view of the heatsink of FIG. 4 showing a channel slot according to an example embodiment in accordance with the principals of the present invention.
Figure 6:
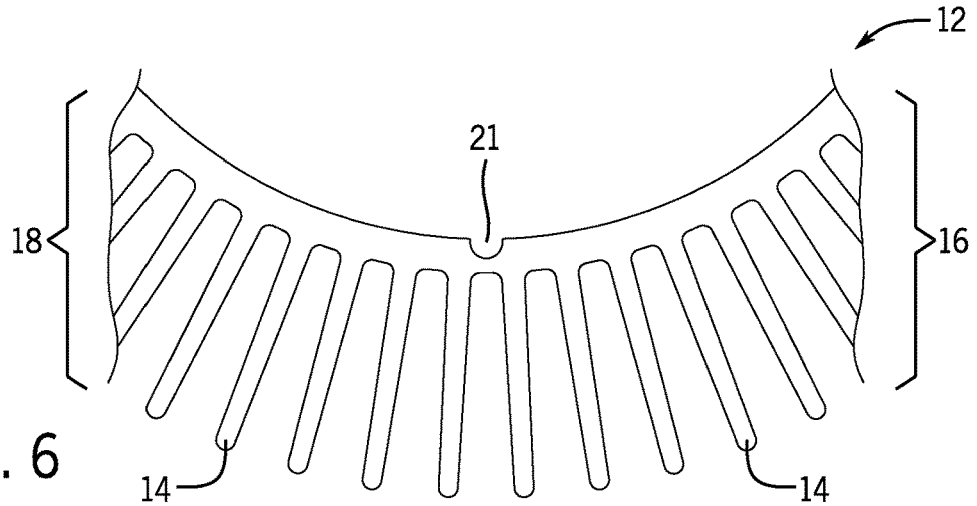
FIG. 6 is a close-up view of the heatsink of FIG. 4 showing a living hinge according to an example embodiment in accordance with the principals of the present invention.
Figure 7:
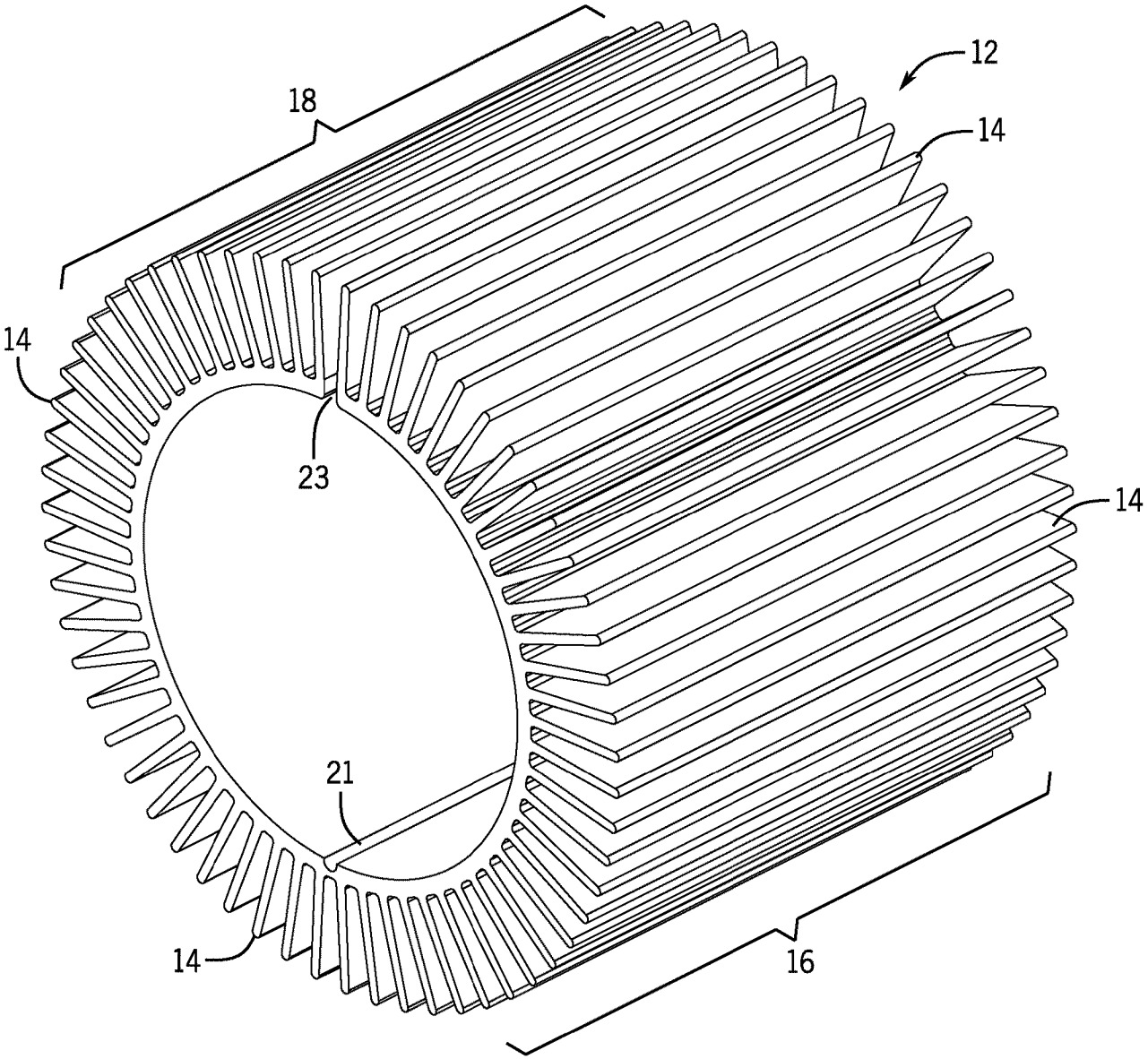
FIG. 7 is an isomeric view of the heatsink of FIGS. 4-6.

The hinge 21 can comprise a living hinge that can be extruded with the heatsink 12 as part of a one-piece manufacturing process with the heatsink 12. The living hinge 21 can provide the closed bias. FIG. 5 is a close-up view of the heatsink 12 of FIG. 4 shown defining a channel slot 23 which, with the hinge 21 define the split design comprising two halves 16, 18. FIG. 6 is a close-up view of the heatsink of FIG. 4 showing the living hinge 21 which, with the channel slot 23 define the split design comprising two halves 16, 18. FIG. 7 is an isomeric view of the heatsink of FIGS. 4-6.

Figure 8:
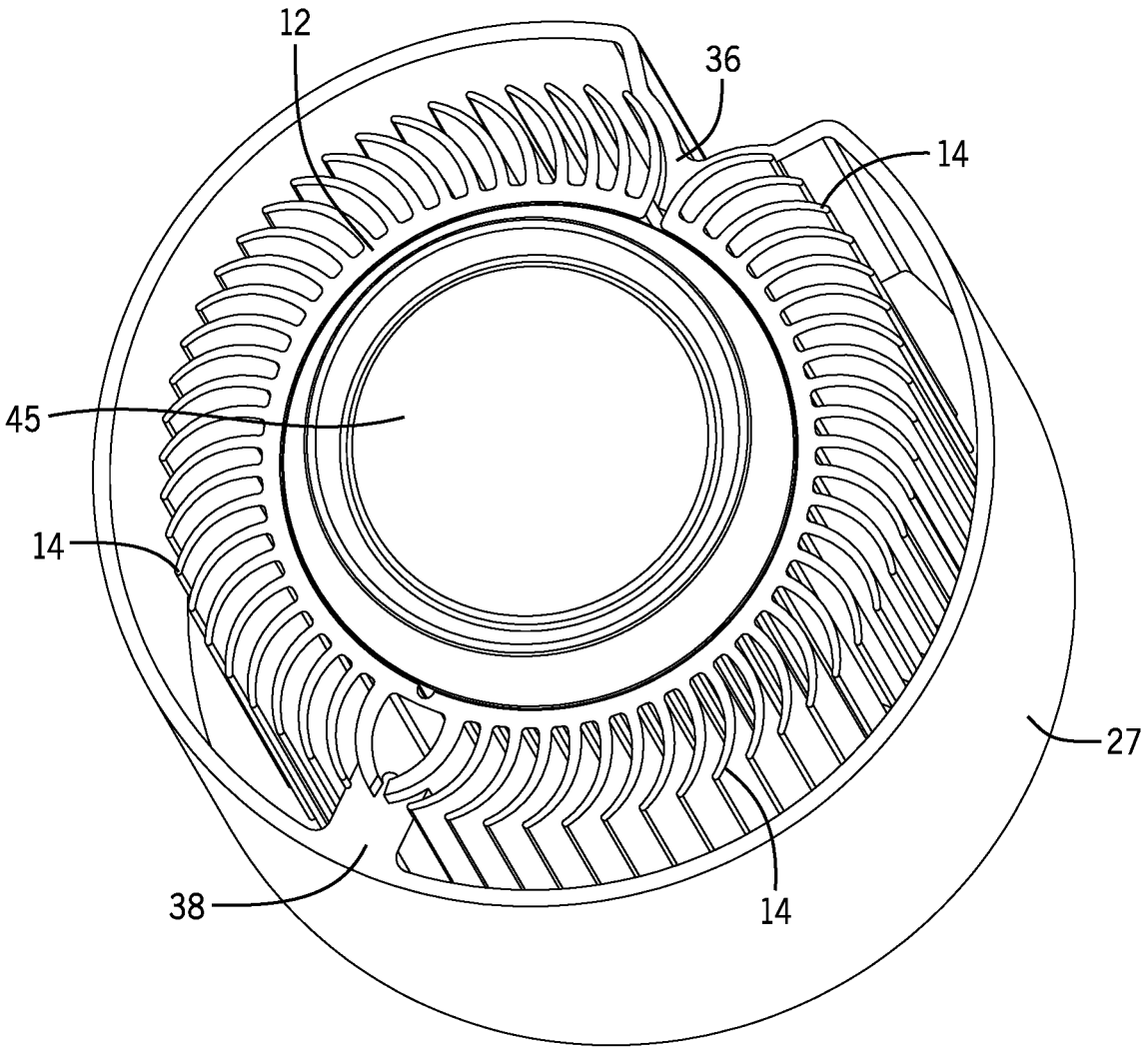
FIG. 8 is perspective view of a heatsink according to an additional example embodiment in accordance with the principals of the present invention placed in a mold according to an example embodiment in accordance with the principals of the present invention.
Figure 26:
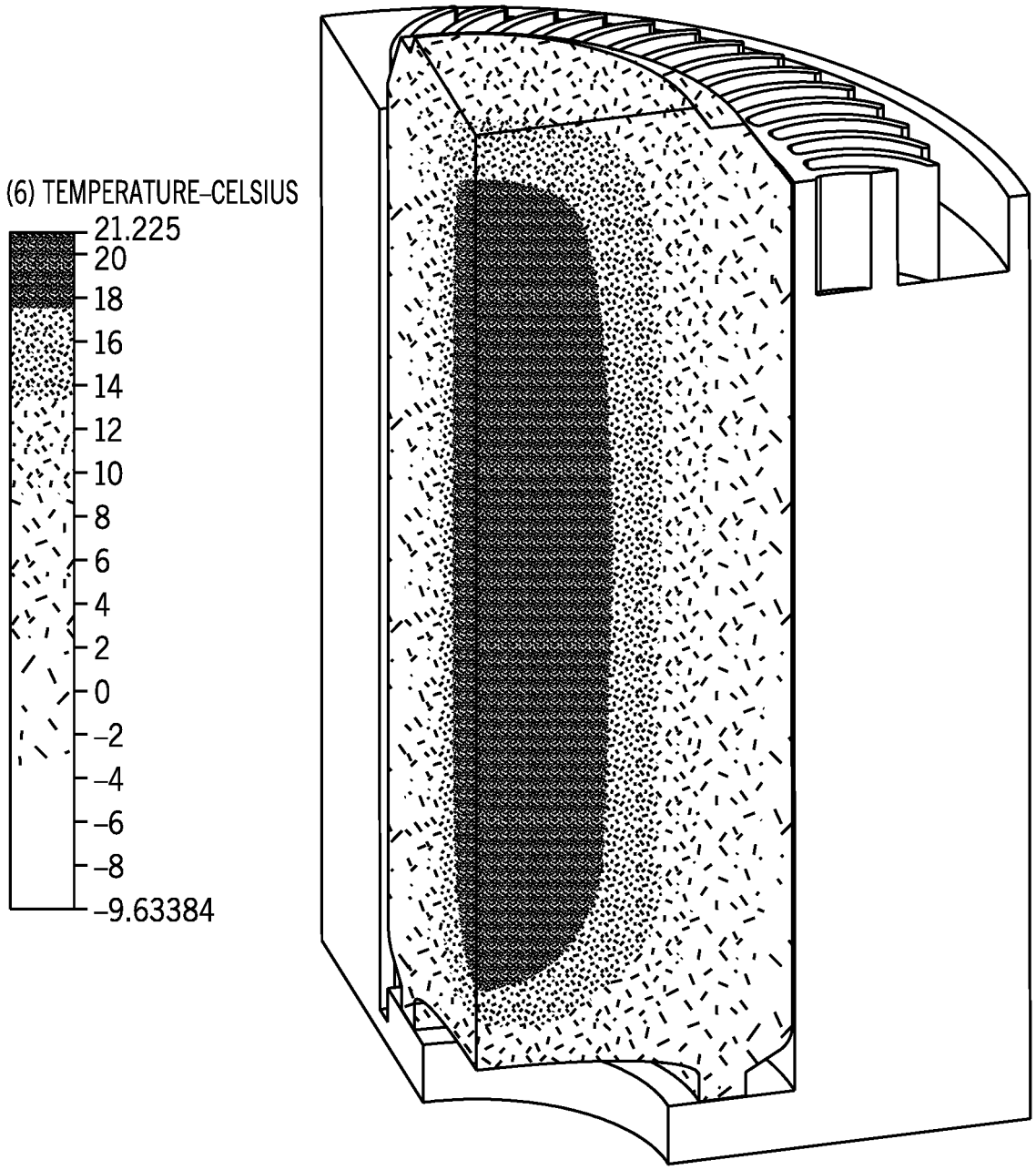
FIG. 26 is a thermal analysis image of the temperature of the beverage of the simulation of FIG. 25 at 300 seconds.
Figure 27:
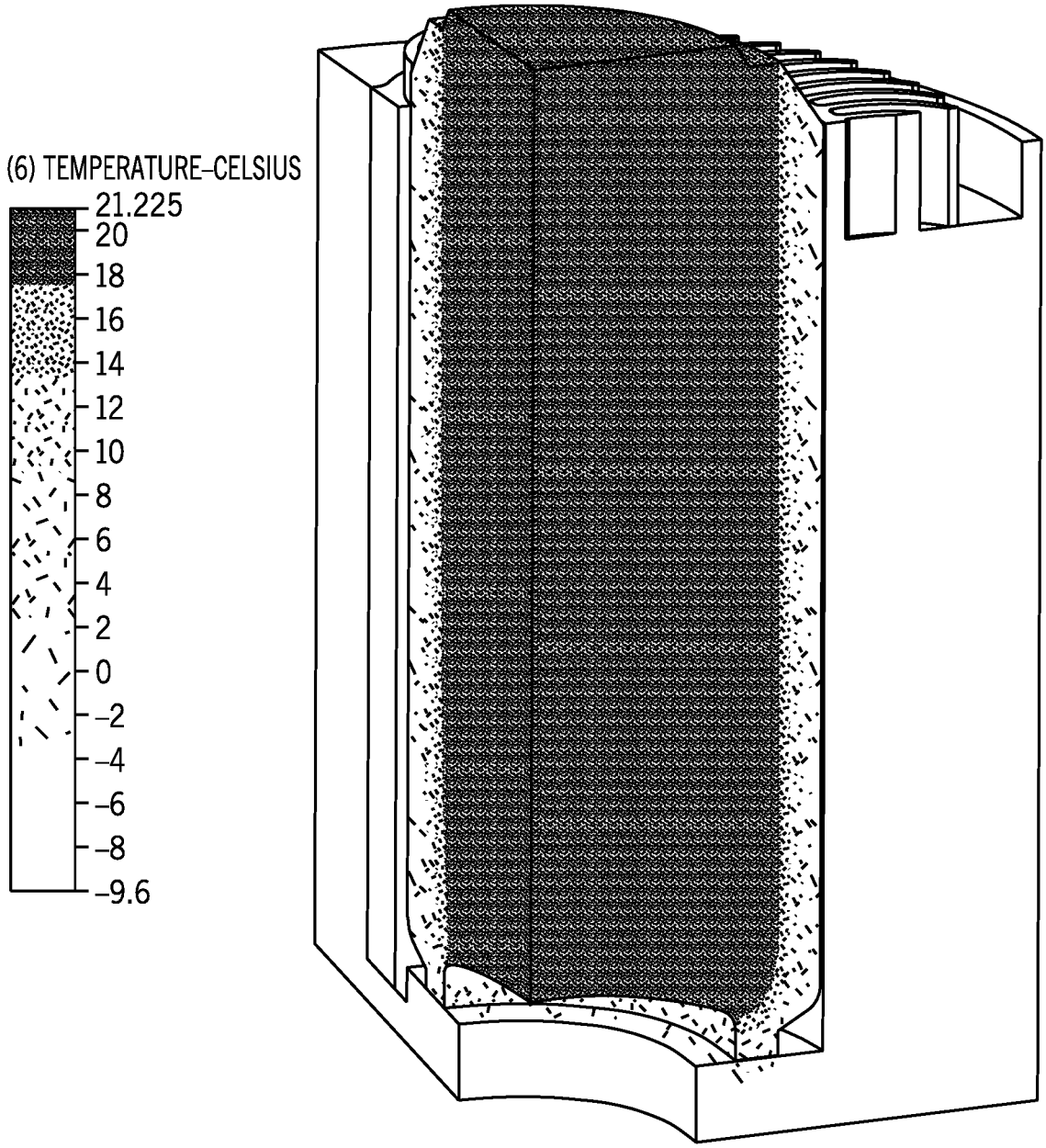
FIG. 27 is a thermal analysis image of the temperature of the beverage of the simulation of FIG. 25 at 15 seconds.

Referring to FIG. 8, a heatsink 12 according to an additional example embodiment in accordance with the principals of the present invention is seen placed in a heatsink mold 27 according to an example embodiment in accordance with the principals of the present invention detailed below. In addition to defining a channel slot 23 and a hinge 21, the heatsink 12 of FIG. 8 includes curved fins 14. The curved fins 14 are oriented as curving outwardly away from the channel slot 23 at one periphery of the heatsink 12 and inwardly towards the hinge 21 at another periphery of the heatsink 12. As detailed below with respect to FIGS. 25-27, analysis demonstrates that adding curves to the fins 14 increases the length of contact between the fin 14 and the working mass while reducing the overall required diameter such that for the same surface area contact, the overall device can be smaller. The spirals of the curved fins 14 run in two different directions so that there can be two fins that hit each other to act as a hard stop so reduce stress and yield on the hinge. The curved fins 14 also provide a visual to assist in recognizing the parting line if the user opens the device to insert or remove the beverage can.

As previously described, in one aspect in accordance with the principals of the present invention, the heatsink 12 can be placed in a mold 27, filled with water as the working mass, and frozen to prepare the cold tube 10 adapted to securely surround the beverage can for use. Ice has very high heat capacity and is inexpensive, but has low thermal conductivity. The conductive heatsink 12 helps dissipate the heat into the high thermal ice mass. The ice also allows the device to function in a non-subzero environment and can eliminate the risk of freezing the beverage.

The volume of ice and thus the diameter of the mold can be sized such that the ice goes through its phase change when the optimal temperature of the beverage has been reached. To account for variations in beverage starting temperature and freezer temperature/settings, the user can control the volume of water poured in to the device. For example, if the beverage can is stored in a hot environment, then more water could be poured; contra wise, if the freezer temperature is colder, less water could be poured. The mold could have visual indicators (fill lines) corresponding to the appropriate temperature differentials between the beverage can and the freezer.

Figure 9:
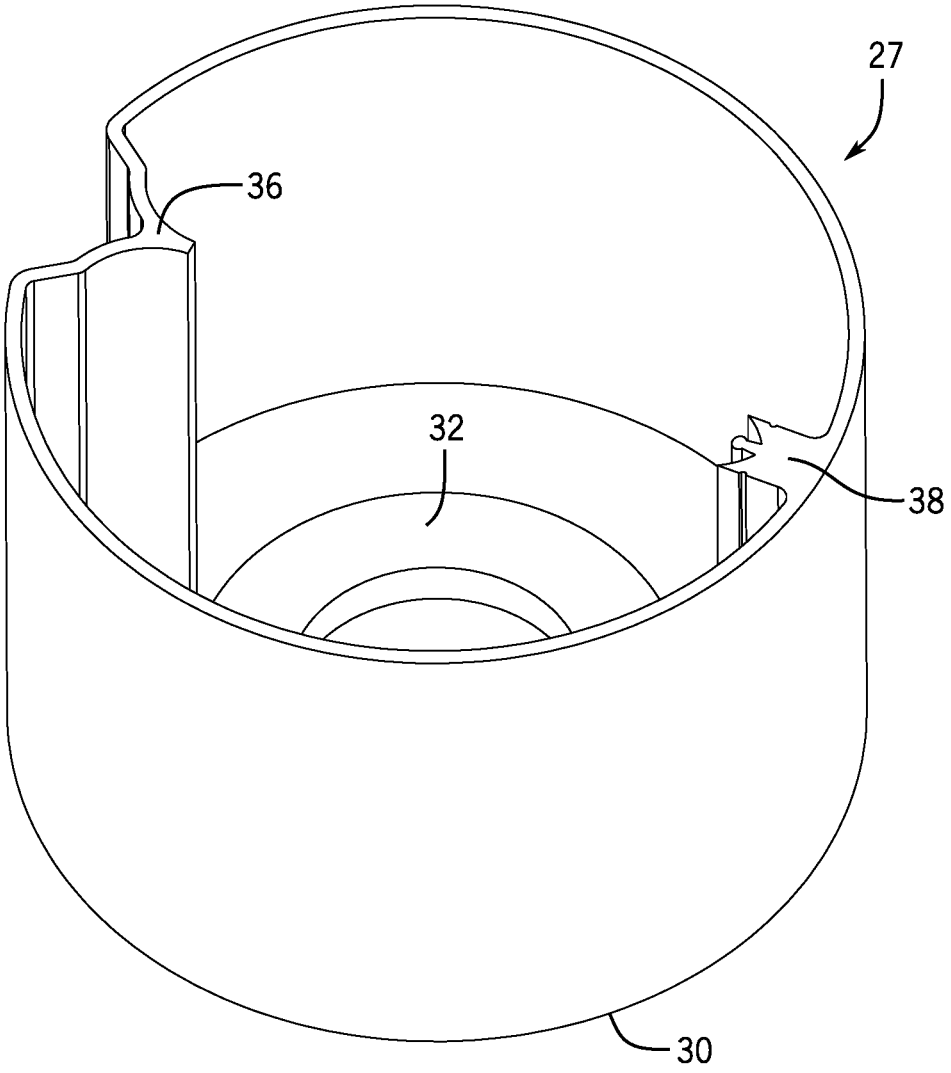
FIG. 9 is perspective view of the heatsink mold of FIG. 8 with the heatsink removed.

FIG. 9 is perspective view of the mold 27 for the heatsink 12 with the heatsink removed. In the most ideal embodiment, the mold can be comprised of a suitable flexible material such as for example a silicone or thermoplastic elastomers. The mold 27 should provide a sufficient seal with the bottom of the heatsink to keep the water from entering the inside of the heatsink to position the ice around the outer periptery but not inwardly of the fins 14. Thus, in one aspect in accordance with the principles of the present invention the bottom floor 30 of the mold 27 defines an upwardly extending ridge 32 that acts as a seal with the interior of the heatsink 12. In an alternative aspect in accordance with the principles of the present invention, if a better seal is desired the bottom floor 30 can define a plurality of fin receptors into which the fins 14 of the heatsink 12 fit.

As previously described, the heatsink 12 can define a channel slot 23 which, in conjunction with the hinge 21 define the split design comprising two halves 16, 18, allowing the heatsink 12 to expand around the beverage can and achieve sufficient contact pressure/surface area for condition between the two elements conducting thermal transfer. To facilitate the split design comprising two halves 16, 18, the mold 27 can define a channel slot indentation 36 and a hinge indentation 38. The channel slot indentation 36 and the hinge indentation 38 further defined fin slots 41 into which the fins 14 of the heatsink 12 adjacent to the channel slot 23 and the hinge 21 fit. This can be seen in FIG. 8.

In addition to defining a channel slot 23 and a hinge 21, the heatsink 12 of FIG. 9 includes curved fins 14. The curved fins 14 are oriented as curving outwardly away from the channel slot 23 at one periphery of the heatsink 12 and inwardly towards the hinge 21 at another periphery of the heatsink 12. As with the placement of the fin receptors on the bottom floor 30 of the mold 27, placement of the fins 14 of the heatsink 12 adjacent to the channel slot 23 and the hinge 21 into the fin slots 41 of the channel slot indentation 36 and the hinge indentation 38 positions the working mass round the outer periptery but not inwardly of the fins 14.

Figure 10:
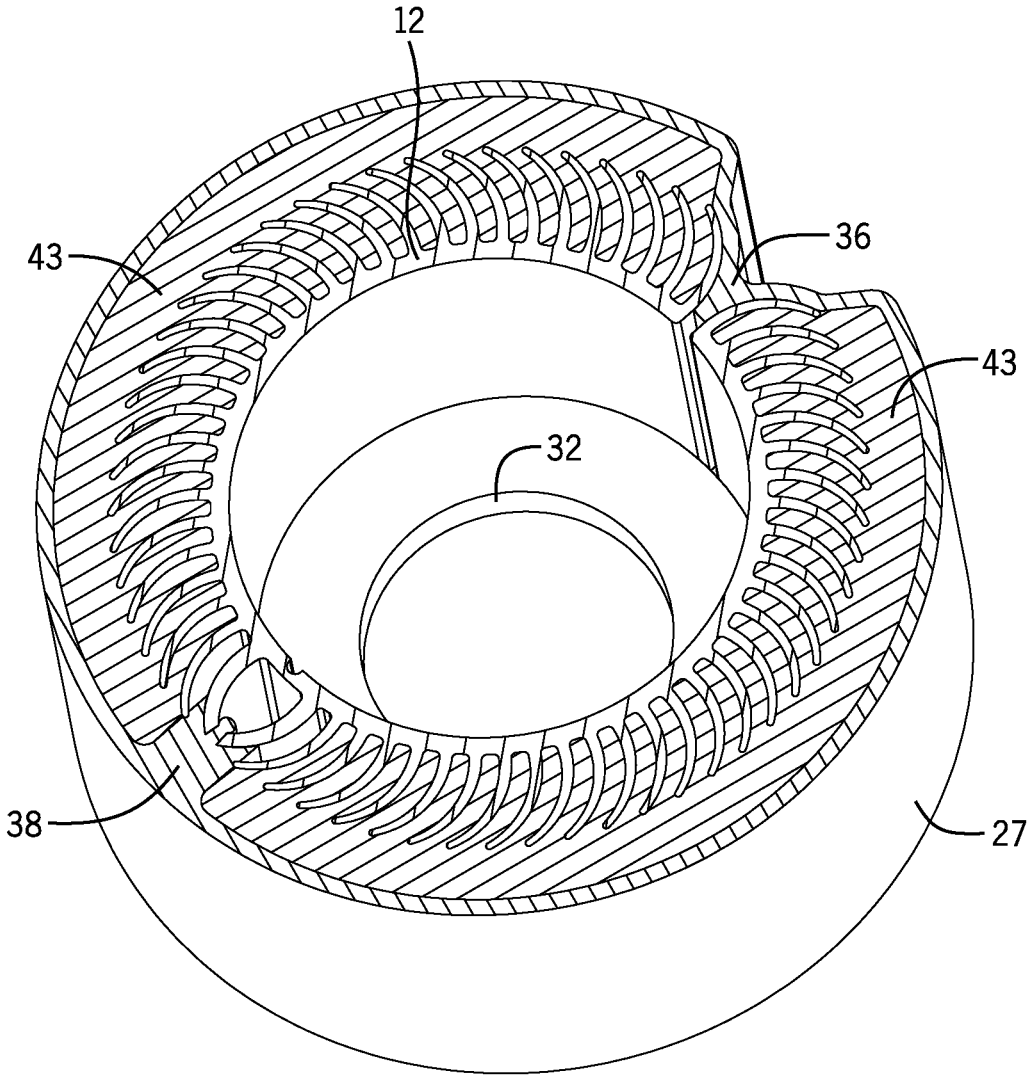
FIG. 10 is a cross-sectional view of the heatsink and mold of FIG. 9 with working mass included.
Figure 11:
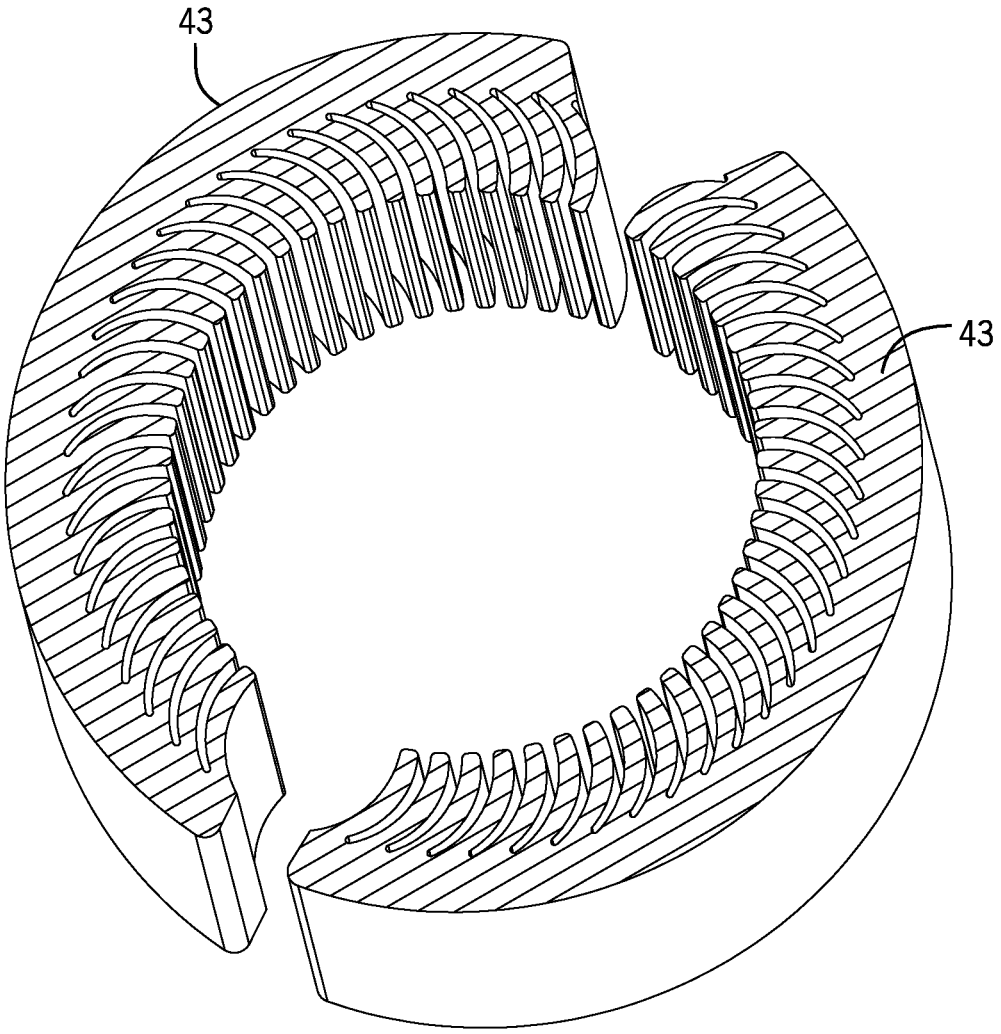
FIG. 11 is an exploded cut-away view of working mass formed around/within the heatsink and within the mold of FIG. 9.

This can be seen in FIG. 10, which is a cross section of the heatsink of FIG. 9 placed in the heatsink mold of FIG. 8 with water or working mass 43 added between the mold 27 and the heatsink 12. It is also seen that the channel slot indentation 36 and fin slots 41 into which the fins 14 of the heatsink 12 adjacent to the channel slot 23 fit have kept working mass from forming at the slot indentation 36; likewise, the hinge indentation 38 and fin slots 41 into which the fins 14 of the heatsink 12 adjacent to the hinge 21 fit have kept working mass from forming at the hinge 21, thus forming the working mass block 43 further defining the split design comprising two halves 16, 18. This can best be seen in FIG. 11, which shows an exploded cut-away view of working mass 43 formed around/within the heatsink with the mold removed.

Figure 12:
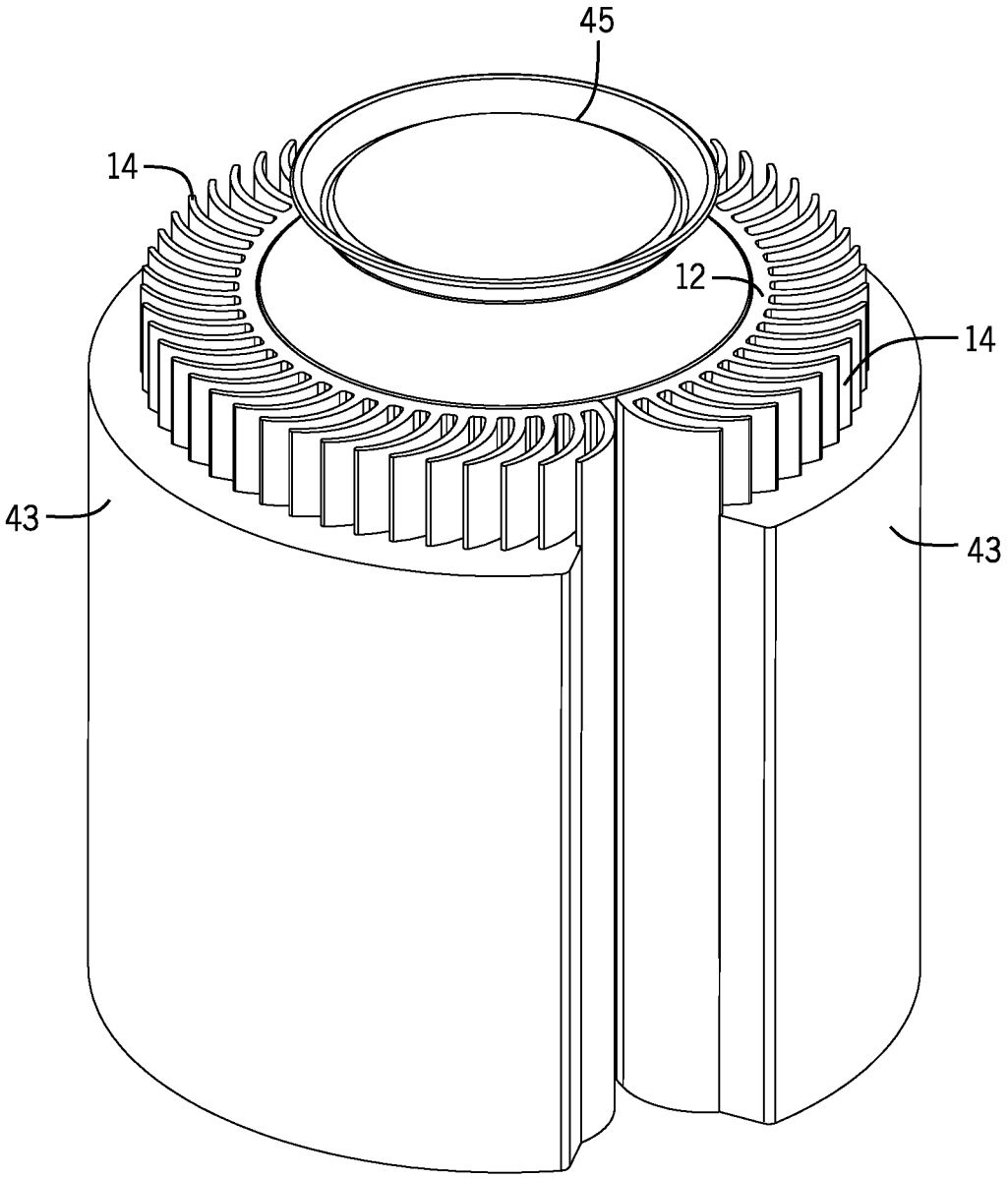
FIG. 12 is perspective cut-away view with the mold removed for illustrative purposes.
Figure 13:
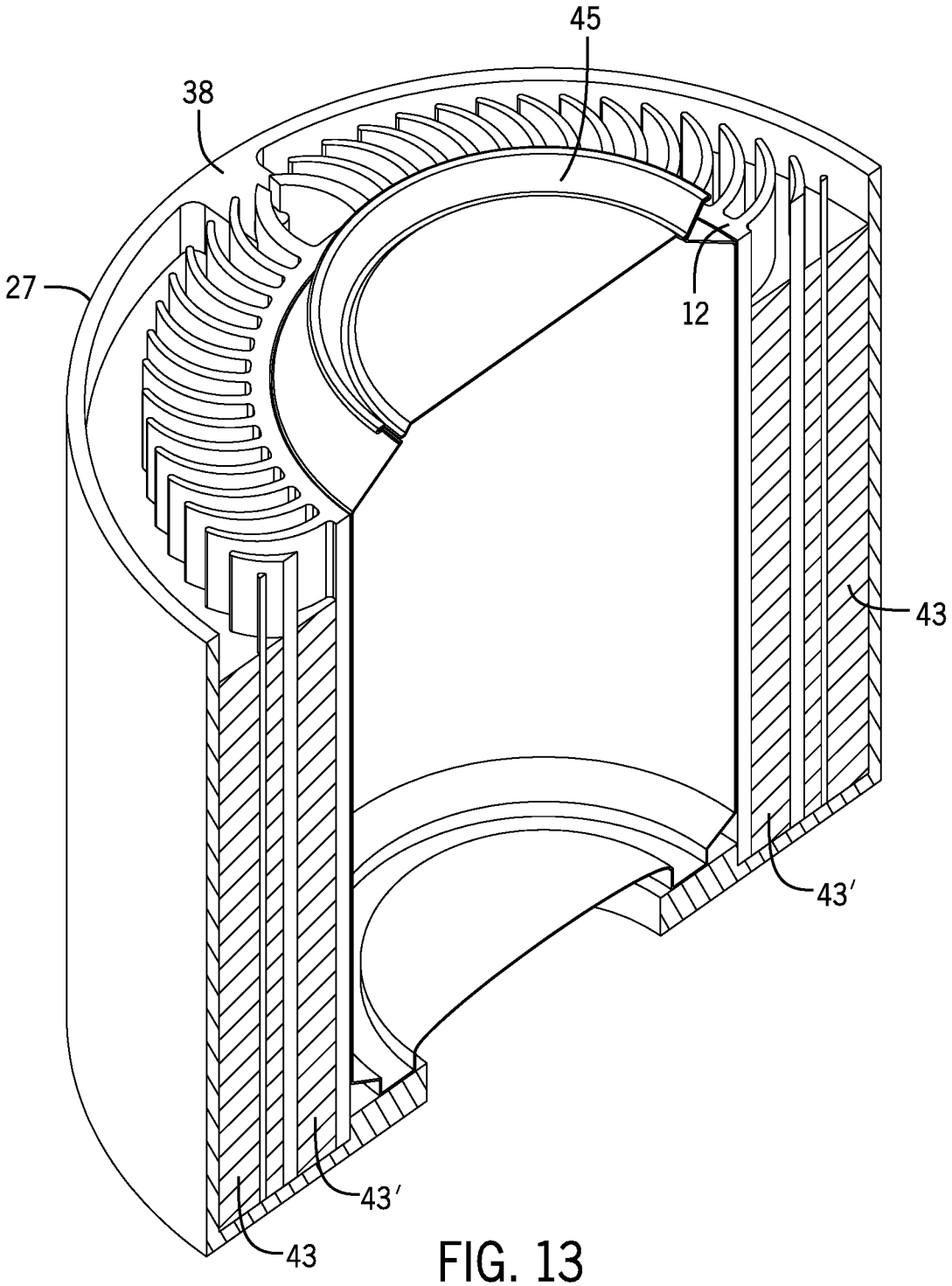
FIG. 13 is a cross section of the heatsink and mold of FIG. 9 with a beverage can in place.

FIG. 12 is perspective, cut-away view with the mold removed and holding a beverage can 45 with a beverage being cooled while FIG. 13 is a cross section of the heatsink and mold of FIG. 9 with a beverage can in place. The cross-sectional view of FIG. 13 shows not only the block of working mass 43 formed between the heatsink 12 and the mold 27 but also shows the working mass 43' formed in-between the fins 14.

Figure 14:
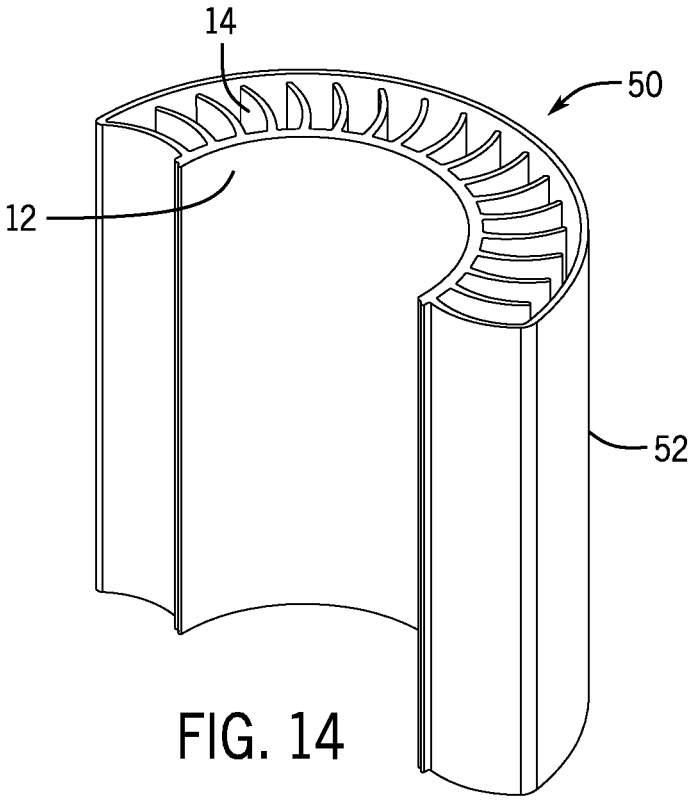
FIG. 14 is a perspective view of a portion of an alternative embodiment of a cold tube according to an example embodiment in accordance with the principals of the present invention.

While the embodiment of claims 4-6 provided an improvement in accommodating manufacturing tolerances in beverage can diameters and in maintaining surface contact with the walls of the beverage can over that of the embodiment of claims 1-3, in a further embodiment this aspect of the design is further improved. FIG. 14 is an elevated view of another embodiment of a cold tube 10 according to an additional example in accordance with the principals of the present invention. In this aspect in accordance with the principals of the present invention, a heatsink 12 can comprise a split design comprising at least two separate halves, one of which 50 is seen in FIG. 14. In this additional embodiment in accordance with the principals of the present invention, the heatsink 12 can be confined in an integral outer tube 52 made from for example aluminum extruded with the heatsink as part of a one-piece manufacturing process. The combined heatsink 12 and outer tube 52 can be capped by a cap 54 (seen in FIG. 17) to contain the working mass. The integral outer tube 52 can be factory or user filled with the working mass.

Figure 15:
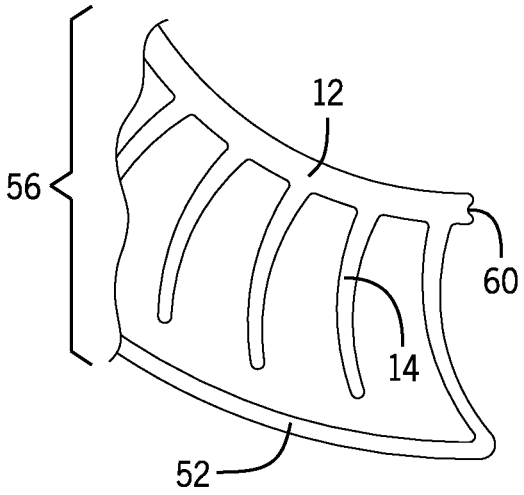
FIG. 15 is a close-up view of the heatsink of FIG. 14 showing an inwardly extending mating member according to an example embodiment in accordance with the principals of the present invention.
Figure 16:
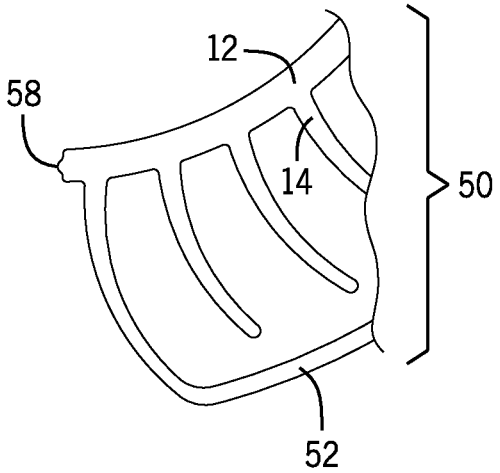
FIG. 16 is a close-up view of the heatsink of FIG. 4 showing an outwardly extending mating member according to an example embodiment in accordance with the principals of the present invention.
Figure 17:
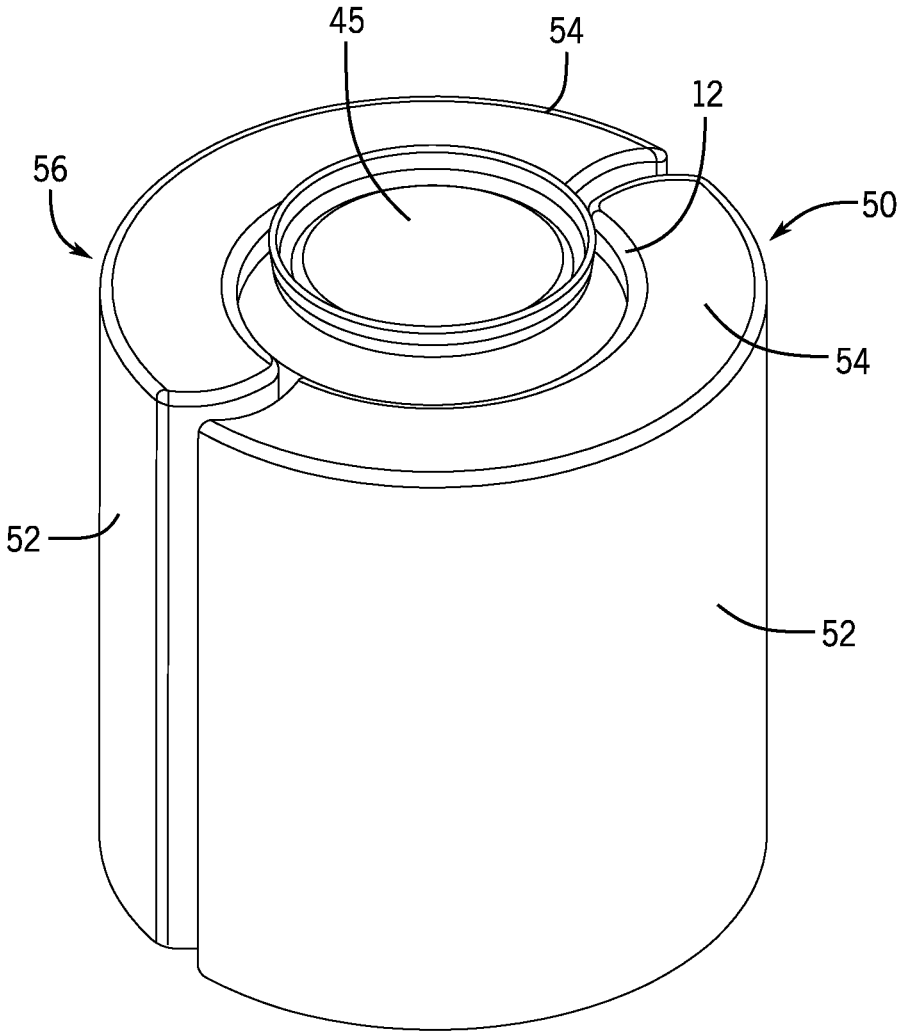
FIG. 17 is a perspective view of a heatsink according to the alternative example embodiment of FIGS. 14-16, without the biasing sleeve in place.

In this aspect in accordance with the principals of the present invention, the separate halves 50 can comprise mating members that can be extruded with the heatsink 12 as part of a one-piece manufacturing process with the heatsink 12. The mating members enable the sections to fit together and align. FIG. 15 is a close-up view of the heatsink 12 of FIG. 14 while FIG. 16 is a close-up view of an additional half 56 showing the mating members. One half 50 can comprise an outwardly extending mating member 58 adapted to fit within an inwardly extending mating member 60 of the other half 56. Thus, FIG. 17 shows the heatsink halves 50, 56 positioned by the outwardly extending mating member 58 and inwardly extending mating member 60 around a beverage can 45.

Figure 18:
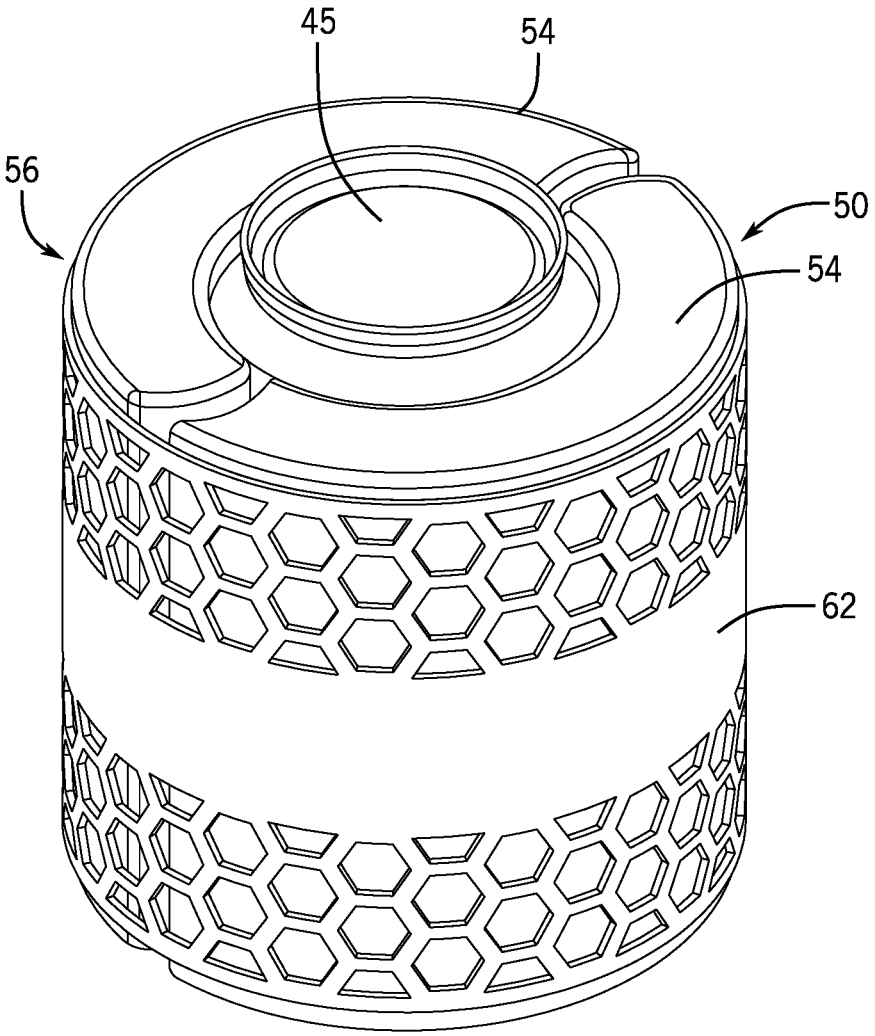
FIG. 18 is a perspective view of a heatsink according to the alternative example embodiment of FIGS. 14-16, with the biasing sleeve in place.

Referring to FIG. 18, in this aspect in accordance with the principals of the present invention the separate halves 50, 56 can be biased together with a biasing sleeve 62 such as for example an elastic, rubber or spring band to apply inward pressure to the beverage can 45. The biasing sleeve 62 can be further comprised of an insulating material that acts both as insulator and an elastic band to bias the separate halves 50, 56 around the beverage can and secure the separate halves 50, 56 positioned via the mating members 58, 60.

Figure 19:
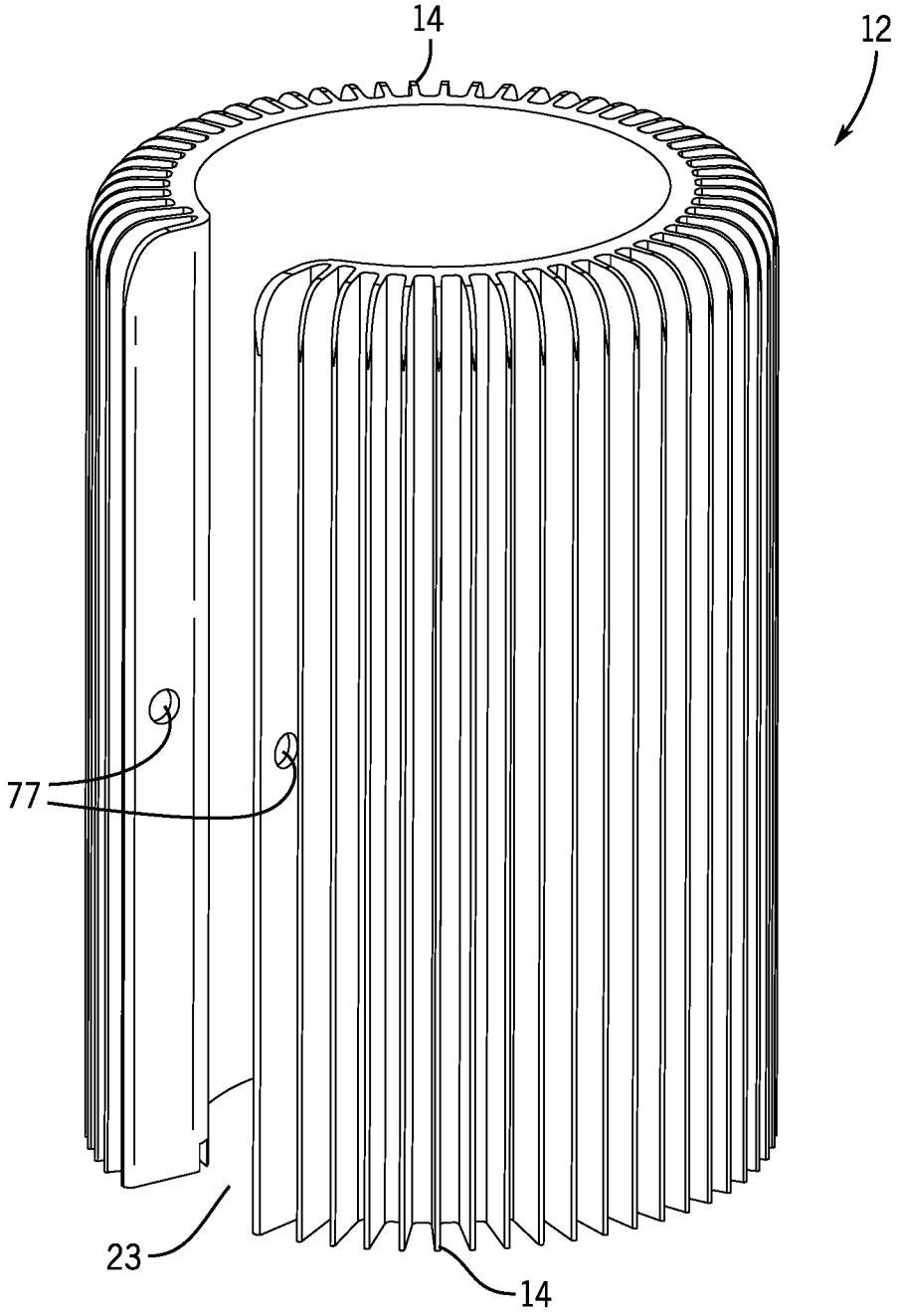
FIG. 19 is a perspective view of a portion of another alternative embodiment of a cold tube according to another example embodiment in accordance with the principals of the present invention.

While the embodiment of FIGS. 8-11 provided an improvement in accommodating manufacturing tolerances in beverage can diameters and in maintaining surface contact with the walls of the beverage can over that of the embodiment of FIGS. 5-6, in a further embodiment this aspect of the design is further improved. FIG. 19 is an elevated view of another embodiment of a heatsink 12 according to an additional example embodiment in accordance with the principals of the present invention. In this aspect in accordance with the principals of the present invention, the heatsink 12 can comprise a C-shaped design defining a single channel slot 23. Again, contained within the cold tube 10 a plurality of fins 14 are provided adapted to increase conductive heat dissipation, thus acting as a heatsink 12.

In this embodiment, the inner diameter of the heatsink can be preferably manufactured to be slightly less than the standard outer diameter of a beverage can. Utilizing the C-shape combined with the natural pliability of the conductive material comprising the C-shaped heatsink 12 enables C-shaped heatsink 12 to be expanded when being placed around the beverage can; thereby, when the expanding pressure is relieved the natural pliability of the conductive material enables the heatsink 12 to slightly contract thus tightly "clamping" the heatsink 12 around the beverage can. This enables the heatsink 12 to better accommodate variations in beverage can diameter.

This also achieves improved contact pressure and increases surface contact area between the heatsink 12 and the beverage can to increase thermal transfer from the contents of the beverage can. Still further, this embodiment reduces manufacturing and material costs as by utilizing the C-shaped heatsink 12 can be extruded as a single part and taking advantage of the natural pliability of the conductive material eliminates the need for an additional biasing component which, in addition to additional cost, easily can be misplaced or lost. To use this embodiment the C-shaped heatsink 12 is clamped around a beverage can and placed in a freezer, with the fins 14 facilitating an increased thermal transfer from the contents of the beverage can.

Figure 20:
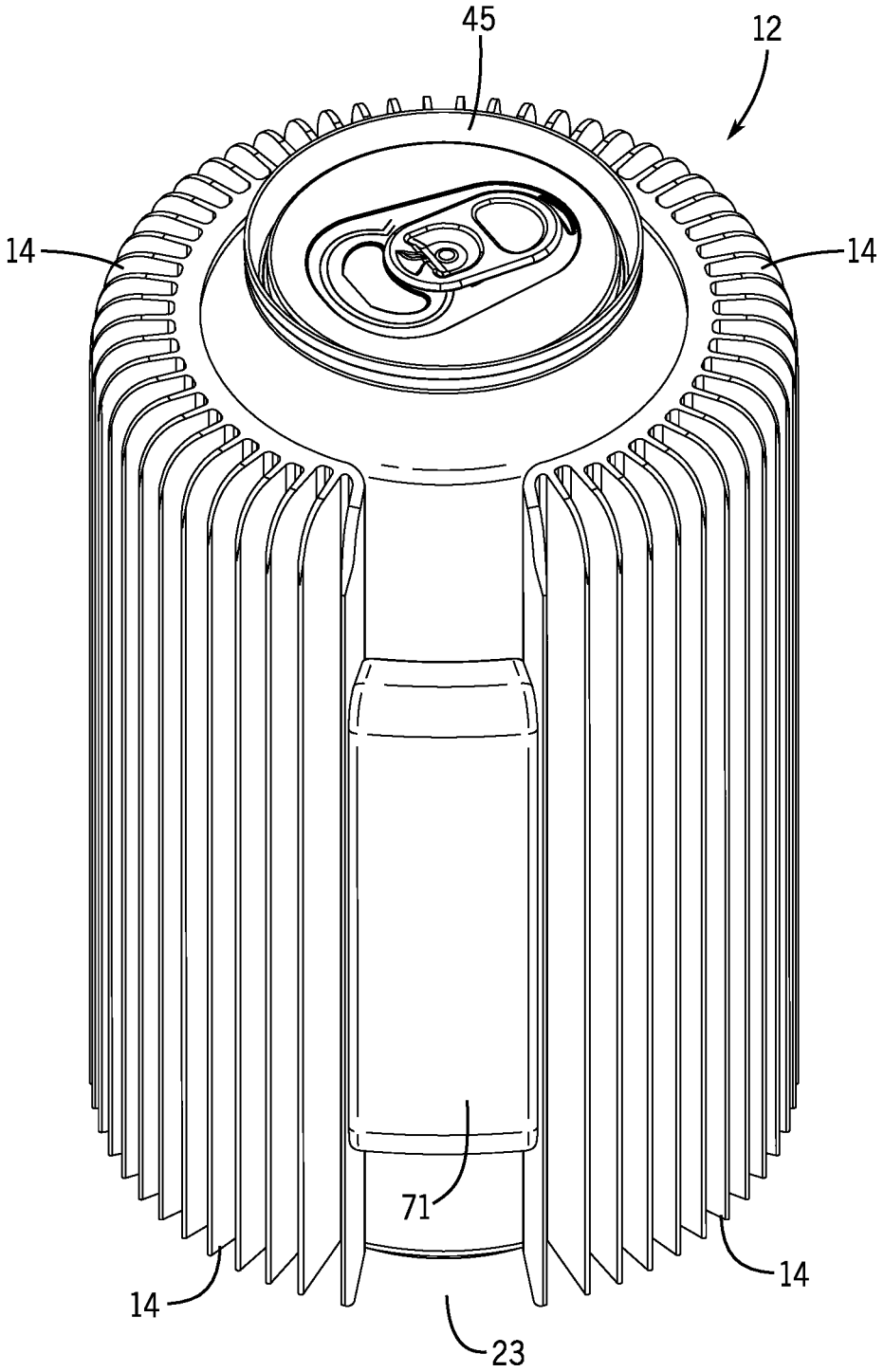
FIG. 20 is a perspective view of a lever in the cold tube of FIG. 19 in accordance with the principals of the present invention.

In order to facilitate the "clamping" of the heatsink 12 around the beverage can 45, a prying mechanism can be provided that can apply a force sufficient to slightly pry open the C-shaped heatsink 12. This prying mechanism could comprise a wedge, a lever, a cam, and the like. In an embodiment, a lever 71 can be provided as this prying mechanism to assist in expanding the heatsink 12. Referring to FIG. 20, the embodiment of the heatsink 12 of FIG. 19 is seen with the lever 71. In order to accompany the lever 71, in this embodiment the channel slot 23 preferably employs an enlarged width. Thus, in FIG. 20 the lever 71 is seen wedged within the single, enlarged channel slot 23. The lever 71 can be comprised of a suitable rigid material such as for example plastic. The lever 71 comprises a girth and occupies a length of the enlarged channel slot 23 sufficient to provide the lever 71 with sufficient structural integrity and force for the material choice to provide an expanding force against the material of the heatsink 12.

Figure 21A:
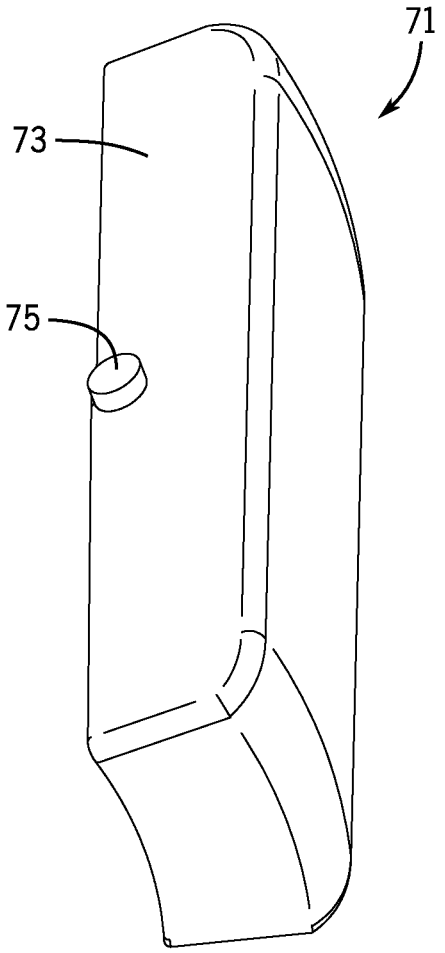
FIG. 21A is a perspective view showing detail of the front of the lever of FIG. 20.
Figure 21B:
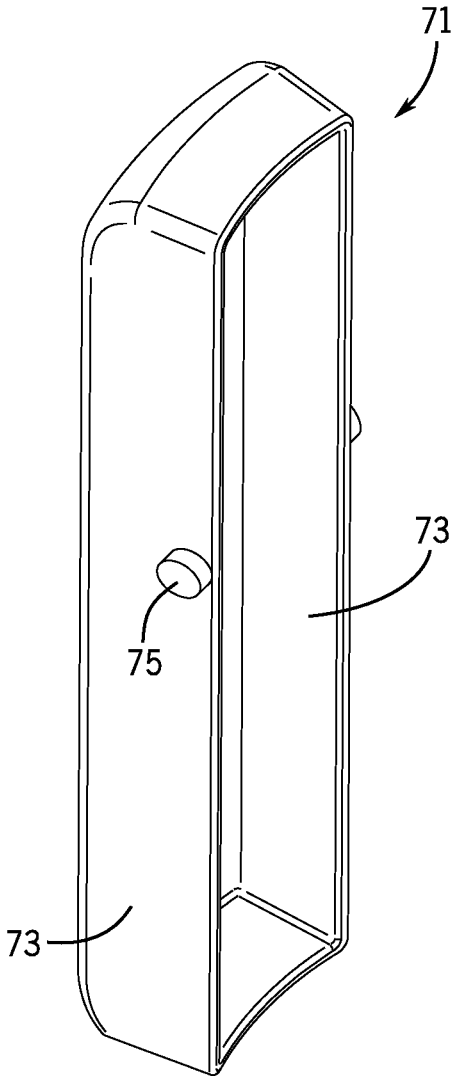
FIG. 21B is a perspective view showing detail of the rear of the lever of FIG. 20.

Referring to FIG. 21, detail of an example lever 71 in accordance with the principles of the present invention is seen, with FIG. 21A showing a perspective view of the front of the lever 71 and with FIG. 21B showing a perspective view of the rear of the lever 71. The lever 71 comprises inwardly tapered sides 73 to provide the expanding force against sides of the enlarged channel slot 23. Thus, the inner width of the lever 71 is sized slightly less than the width of the enlarged channel slot 23 while the outer width of the lever 71 is sized slightly greater than the width of the enlarged channel slot 23.

A pair of male nubs 75 can be provided on the lever sides 73. The male nubs 75 of the lever sides 73 cooperate with a pair of female apertures 77 defined in the sides of the enlarged channel slot 23 to secure the lever 71 within the enlarged channel slot 23. The male nubs 75 and female apertures 77 can thus provide a pivot point for the lever 71 such that when the top of the lever 71 is pushed inwardly expanding pressure is applied against the top of the C-shaped heatsink 12 while when the top of the lever 71 is pulled expanding pressure is applied against the bottom of the C-shaped heatsink 12; likewise, when the bottom of lever 71 is pushed inwardly expanding pressure is applied against the bottom of the C-shaped heatsink 12 while when the bottom of the lever 71 is pulled expanding pressure is applied against the top of the C-shaped heatsink 12. In an alternative embodiment, instead of the plastic nubs 75 in the lever 71 a pair of metal pins or a single metal axle can be provided to establish the pivot point for the lever 71. Utilizing metal pins or a metal axal can provide for increased force to be applied if this additional force is required to be applied to the sides of the enlarged channel slot 23 to pry slightly open the C-shaped heatsink 12.

Figure 22:
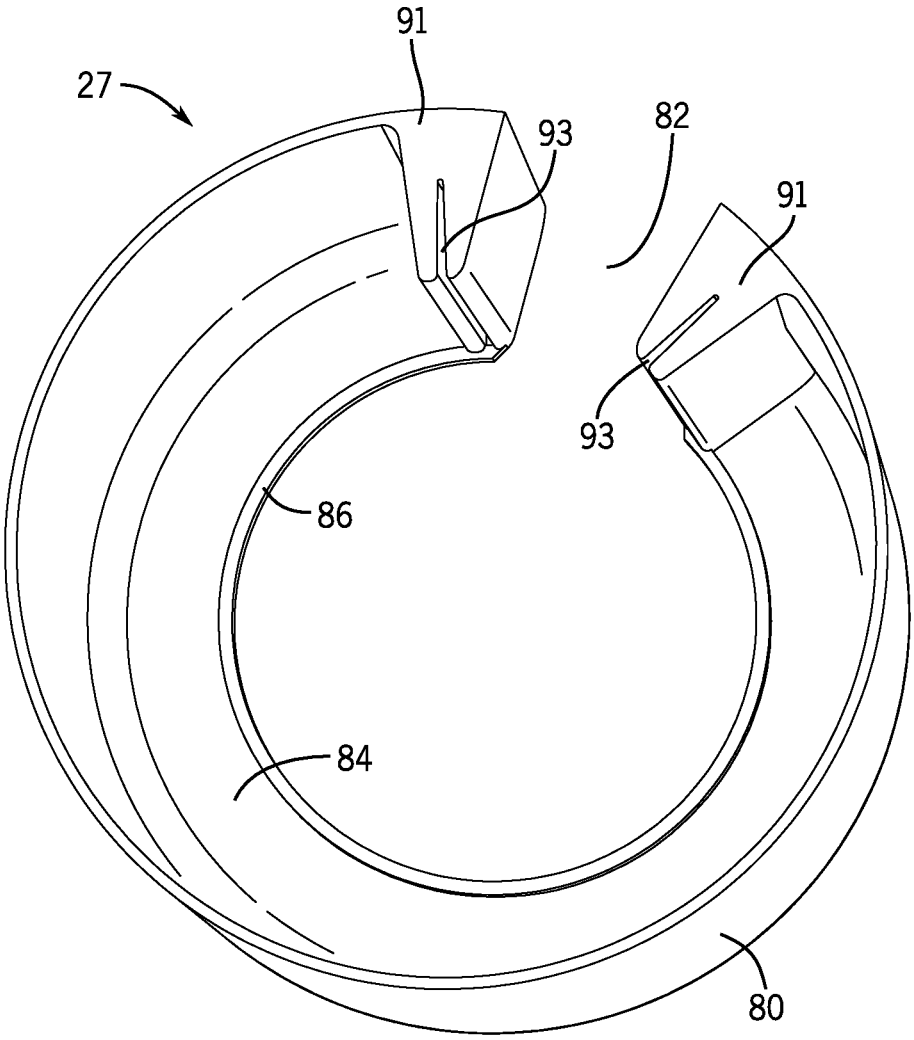
FIG. 22 is a perspective view of another embodiment of a heatsink mold according to an example embodiment in accordance with the principals of the present invention.
Figure 23:
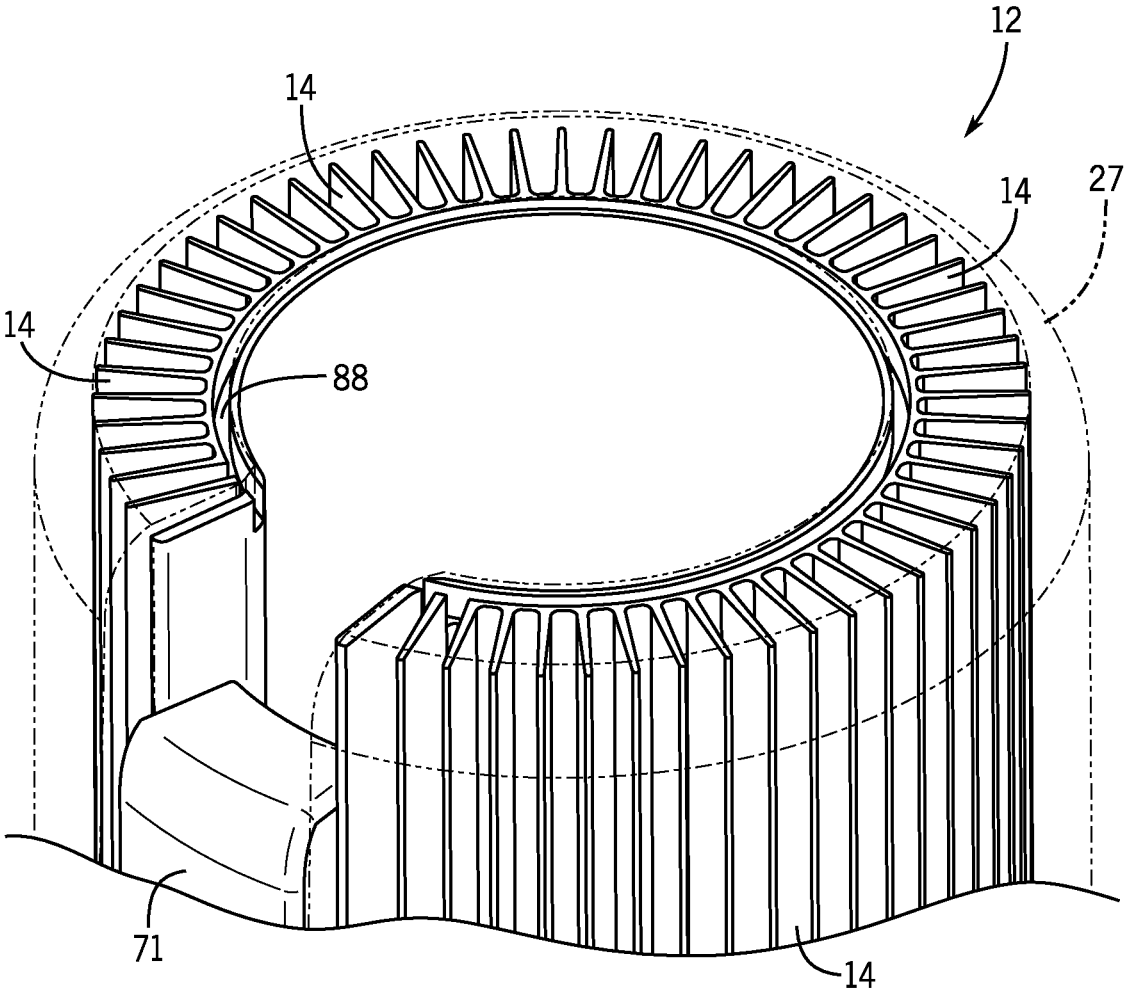
FIG. 23 is a perspective detailed view of the bottom of the cold tube of FIG. 19 showing the inwardly extending grove.

As with the previously described embodiments, in an embodiment the C-shaped heatsink 12 can be utilized with a mold 27 to provide a space to be filled to provide a working mass. Referring to FIG. 22, a perspective view of another embodiment of a heatsink mold 27 according to an additional example embodiment in accordance with the principals of the present invention is seen. Like the cooperating C-shaped heatsink 12, the mold 27 is C-shaped. Thus, the C-shaped mold 27 comprises a sidewall 80 shaped to encompass an outer perimeter of the C-shaped heatsink 12. The sidewall 80 defines an opening 82 corresponding to the enlarged channel slot 23. To seal the bottom of the C-shaped heatsink 12, the C-shaped mold 27 provides an integral bottom 84 which defines an upwardly extending lip 86 defined at the inner periphery thereof. The upwardly extending lip 86 is designed to cooperate with an inwardly extending grove 88 defined at the inner periphery of the bottom of the C-shaped heatsink 12, as seen in FIG. 23 which shows a detailed view of the bottom of the C-shaped heatsink 12. By use of a suitable flexible material for the C-shaped mold 27, a water-tight seal is created between the upwardly extending lip 86 of the integral bottom 84 of the C-shaped mold 27 and the inwardly extending grove 88 of the bottom of the C-shaped heatsink 12.

Figure 24:
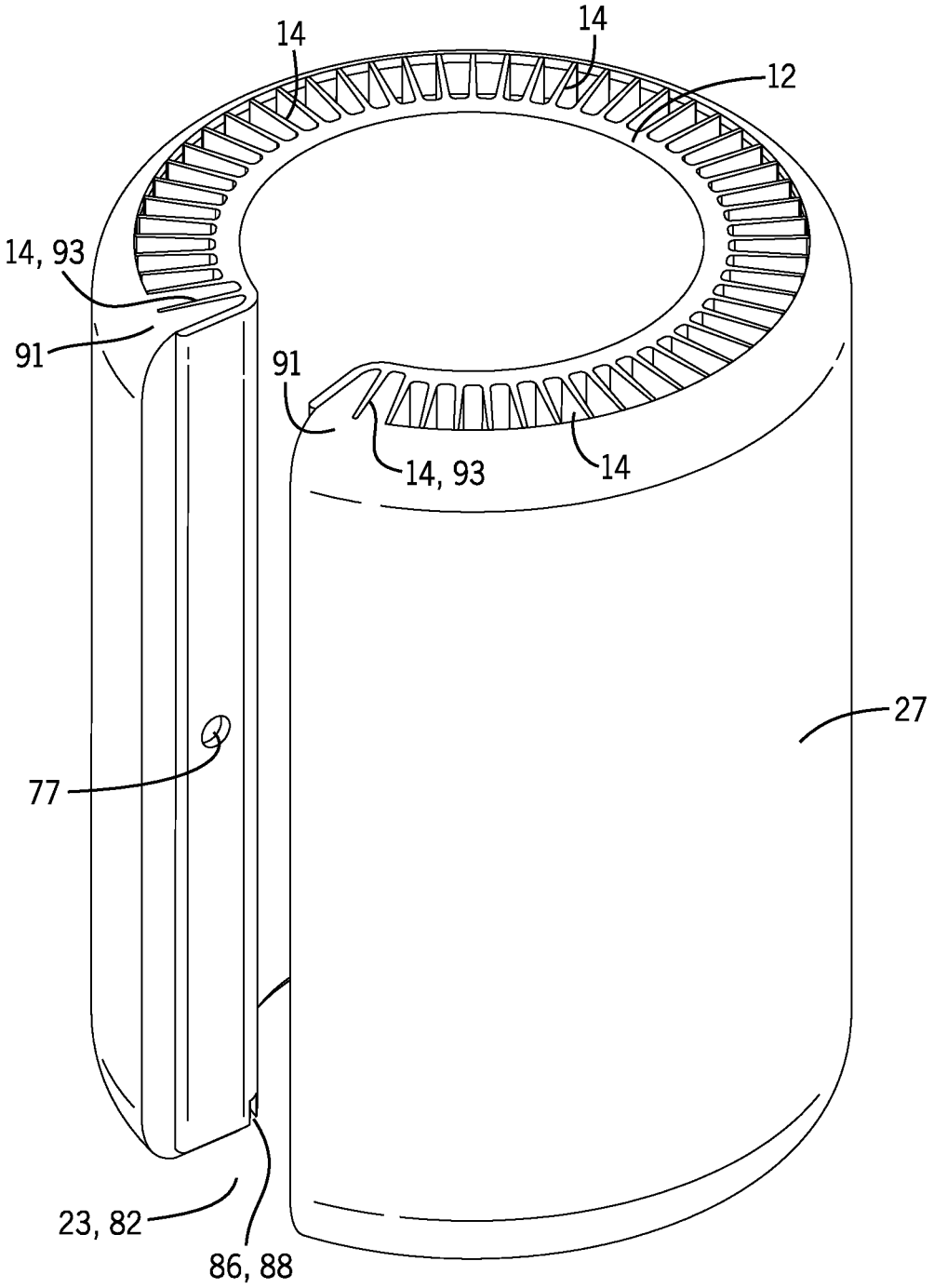
FIG. 24 is a perspective view of the cold tube of FIG. 19 placed in the mold of FIG. 22.

Referring to FIG. 24, a perspective view of the C-shaped heatsink 12 placed in the C-shaped mold 27 is seen. On each side of the opening 82 of the C-shaped mold 27 corresponding to the enlarged channel slot 23, the C-shaped mold 27 includes housing 91 defining an elongated fin slot 93. Each elongated fin slot 93 is defined to receive the fin 14 of the C-shaped heatsink 12 positioned adjacent to each side of the enlarged channel slot 23. By use of a suitable flexible material for the C-shaped mold 27, securing the adjacent fin 14 in the elongated fin slot 93 creates a water-tight seal between the C-shaped mold 27 and the enlarged channel slot 23 of the C-shaped heatsink 12. In addition, the C-shaped mold 27 leaves exposed the sides of the enlarged channel slot 23 so that the pair of female apertures 77 defined therein can receive the pair of male nubs 75 provided on the lever sides 73 so that the lever 71 can be secured within the enlarged channel slot 23 when the C-shaped heatsink 12 is placed in the C-shaped mold 27.

Thus, to use this embodiment the C-shaped mold 27 is secured around the C-shaped heatsink 12, with the upwardly extending lip 86 of the integral bottom 84 of the C-shaped mold 27 secured within the inwardly extending grove 88 of the bottom of the C-shaped heatsink 12 and each fin 14 adjacent each side of the enlarged channel slot 23 secured in each elongated fin slot 93 to seal the space within the C-shaped mold 27 to be filled to provide a working mass. This space on the inside of the C-shaped mold 27 surrounding the C-shaped heatsink 12 is filed with a working fluid such as water and placed in a freezer; when the water is frozen the C-shaped heatsink 12 is ready to use.

The lever 71 is activated, thus pushing against the sides of the enlarged channel slot 23 to cause the inner diameter of the C-shaped heatsink 12 to increase, allowing it to be placed over a beverage can 45. When placed around the beverage can 45, the lever 71 is released, thus causing the inner diameter of the C-shaped heatsink 12 to contract thereby allowing it to "clamp" the beverage can 45. This enables the cold tube 10 to better accommodate variations in beverage can 45 diameter. This also achieves improved contact pressure and increases surface contact area between the heatsink 12 and the beverage can 45 to increase thermal transfer from the contents of the beverage can 45.

Because of this increased thermal transfer from the contents of the beverage can 45, after just a few minutes the beverage is cold and the lever 71 can again be pushed inwardly, thus pushing against the sides of the enlarged channel slot 23 to cause the inner diameter of the C-shaped heatsink 12 to expand, allowing the beverage can to be released and the cold beverage enjoyed.

To calculate the thermal and fluid interactions in a simulated environment of a beverage can cooler in accordance with the principals of the present invention, Computational Fluid Dynamics (CFD) and Computational Thermal Dynamics (CFD) analysis software was utilized using as the working mass frozen water. Heat transfer analysis was conducted between elements from initial starting temperature conditions to show the resulting temperature over time as the beverage cools and the ice melts.

To start, the geometry of a beverage can cooler in accordance with the principals of the present invention was created in 3-D Computer Aided Drawing (CAD) software and imported into CFD software. The material properties were applied with the necessary conductivity and heat capacity. Then, boundary conditions and temperature were assigned. The underlying equations of state were solved. These equations of state are related to the conductive heat transfer and natural convection in the fluid caused by thermal gradient and currents. Post processing tools such as planes and color plots were overlaid onto the model and the mesh to communicate the results. "Mesh" refers to the wireframe structure that is applied to the CAD model in the CFD analysis. The mesh is a serious of nodes and connection points. The simulation is run on each node to determine the temperature and fluid flow. The tighter the mesh, the more accurate the analysis.

To optimize the design of a beverage can cooler in accordance with the principals of the present invention, the fins are of a proper thickness and length to quickly transfer heat to the working mass. The thickness of the base of the fins was chosen to properly extract heat from the outer surface of the beverage can. The thickness of the fins was chosen to optimize the amount of heat being extracted from the base, and also optimize the amount of surface area with the working mass. The gap between the fins (the thickness of the working mass between the fins) was sized such that the working mass goes through its phase change when the optimal temperature of the beverage can has been reached. The profile consists of a specifically designed taper and curvature. To promote heat transfer due to conduction within the material of the device, the taper of the fins was designed to minimize the material while still keeping the fin thickness wide at the base. The curvature of the fins optimizes the surface area while minimizing the overall diameter of the device.

Figure 25:
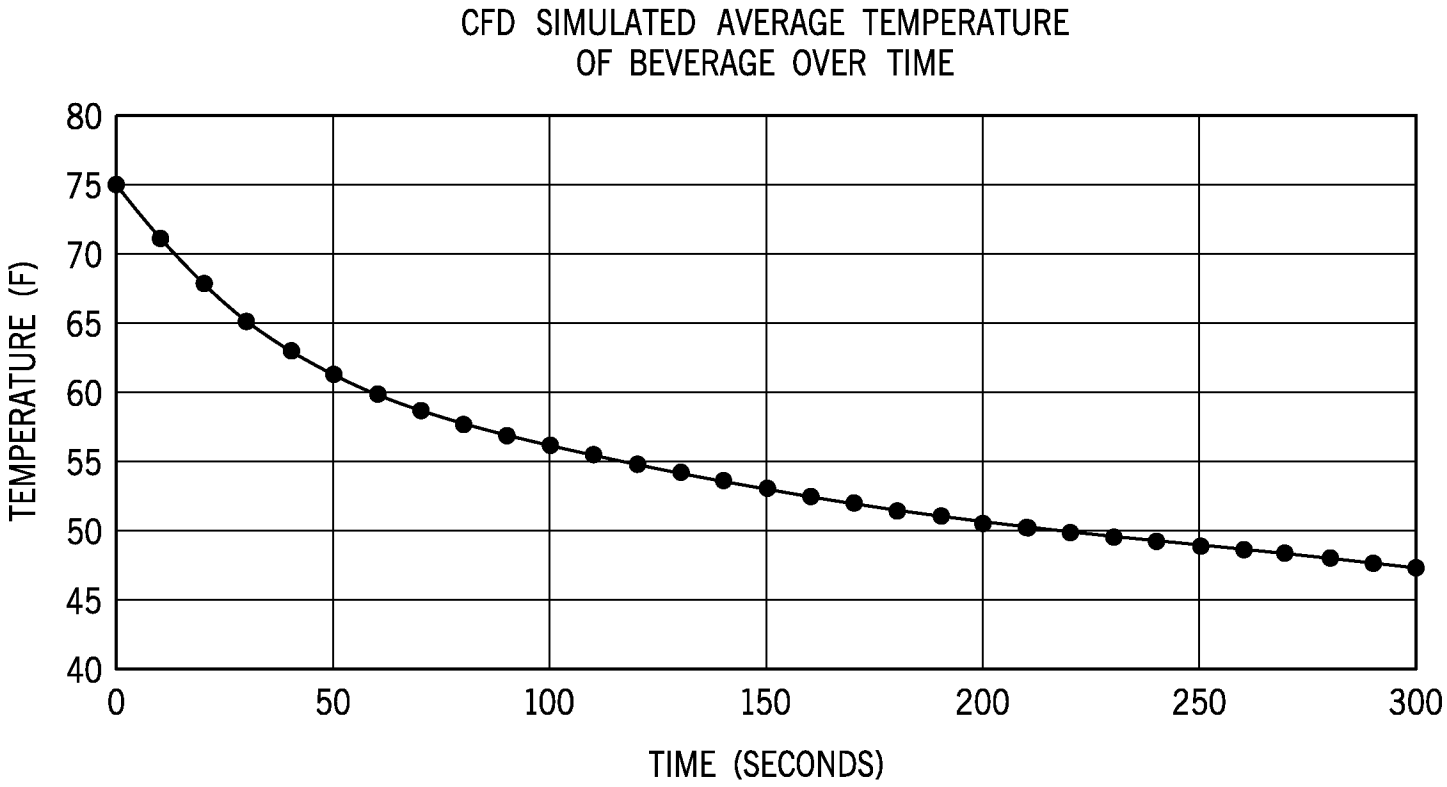
FIG. 25 is a graph of a simulated average temperature of a beverage utilizing a beverage can cooler in accordance with the principals of the present invention.

Referring to FIG. 25, a graph of the CFD simulated average temperature of the beverage over time is seen: temperature is set forth on the vertical axis between 40 degrees and 80 degrees Fahrenheit; time is set forth on the horizontal axis between 0 and 300 seconds. It is seen that utilizing a beverage can cooler in accordance with the principals of the present invention reduces the average temperature from 75 degrees Fahrenheit to 45 degrees Fahrenheit in 300 seconds, or five minutes. The temperature profile of the beverage, can, and beverage can cooler of the present invention at 300 seconds can be seen depicted in the CFD software in FIG. 26; this is contrasted with the temperature profile of the beverage, can, and beverage can cooler of the present invention at 15 seconds, when the temperature of the beverage is approximately 70 degrees Fahrenheit, seen in FIG. 27.

While a beverage can cooler in accordance with the principals of the present invention has been described with specific embodiments, other alternatives, modifications, and variations will be apparent to those skilled in the art. For example, in the alternative embodiment where the heatsink is utilized alone, a fan could be added to provide forced convection. As an additional example, an electro-mechanical means could be added to induce agitation such as for example by spinning the beverage can or rotating, stopping, and rotating the whole device in the opposite directions. Accordingly, it will be intended to include all such alternatives, modifications and variations set forth within the spirit and scope of the appended claims.

The invention claimed is:

1. A beverage can cooler to facilitate cooling contents of a beverage can, the beverage can cooler comprising:

a C-shaped cold tube adapted to securely surround the beverage can, the C-shaped cold tube defining a channel slot;

a prying mechanism contained within the channel slot, the prying mechanism defining a surface that contacts with sides of the C-shaped cold tube in the channel slot, the surface of the prying mechanism exerting an expanding force against sides of the C-shaped cold tube in the channel slot, the expanding force expanding the C-shaped cold tube so as to accommodate variations in beverage can diameter; and contained on the C-shaped cold tube, a plurality of fins adapted to increase conductive heat dissipation, thus acting as a heatsink;

wherein when the expanding force of the prying mechanism against sides of the C-shaped cold tube in the channel slot is released, the C-shaped cold tube contracts around the beverage can facilitating achieving improved contact pressure and increasing surface contact area between the C-shaped cold tube and the beverage can to increase thermal transfer from the contents of the beverage can.

2. The beverage can cooler of claim 1 further wherein the prying mechanism comprises a lever defining inwardly tapered sides to provide an expanding force against sides of the C-shaped cold tube in the channel slot.

3. The beverage can cooler of claim 2 further wherein the lever is of a length to occupy a length of the channel slot sufficient to provide an equally distributed force along the length of the channel slot.

4. The beverage can cooler of claim 2 further wherein the lever comprises an inner width sized slightly less than the width of the channel slot and an outer width sized slightly greater than the width of the channel slot.

5. The beverage can cooler of claim 2 further wherein a pair of male nubs are provided on the lever which cooperate with a pair of female apertures defined on sides of the C-shaped cold tube in the channel slot to secure the lever in the channel slot.

6. The beverage can cooler of claim 1 further wherein the prying mechanism is selected from the group consisting of a lever, a wedge, a cam, and combinations thereof.

7. The beverage can cooler of claim 1 further wherein the C-shaped cold tube can be secured in a corresponding mold in order to create a working mass, the mold comprising:

a sidewall shaped to encompass an outer perimeter of the heatsink of the C-shaped cold tube;

a bottom floor integrally formed with the sidewall, the bottom floor shaped to encompass and seal a bottom of the C-shaped cold tube;

the sidewall and the bottom floor defining an opening corresponding to the channel slot in the C-shaped cold tube; and adjacent to each side of the opening, the sidewall contains housing defining a fin slot, the fin slot adapted to receive a fin of the C-shaped cold tube positioned adjacent to each side of the channel slot, thereby creating a seal between the mold and the channel slot of the C-shaped cold tube.

8. The beverage can cooler of claim 1 further wherein the plurality of fins are curved.

9. The beverage can cooler of claim 1 further wherein the plurality of fins are tapered.

10. The beverage can cooler of claim 1 further wherein the heatsink is comprised of a material selected from the group consisting of aluminum, copper, silver, gold, tungsten, diamond, cubic boron arsenide, graphite, steel, and combinations thereof.

11. The beverage can cooler of claim 1 further wherein the C-shaped cold tube comprises working mass placed around the heatsink.

12. The beverage can cooler of claim 11 further wherein the working mass comprises ice formed by freezing water placed around the heatsink in a mold.

13. The beverage cooler of claim 11 further wherein the working mass comprises antifreeze placed around the heatsink in a mold.

14. A beverage can cooler to facilitate cooling contents of a beverage can, the beverage can cooler comprising:

a C-shaped cold tube adapted to securely surround the beverage can, the C-shaped cold tube defining a channel slot;

means for applying an expanding force against the C-shaped cold tube, the means for applying an expanding force expanding the C-shaped cold tube so as to accommodate variations in beverage can diameter; and contained on the C-shaped cold tube, a plurality of fins adapted to increase conductive heat dissipation, thus acting as a heatsink;

wherein when the expanding force of the means for applying an expanding force against sides of the C-shaped cold tube is released, the C-shaped cold tube contracts around the beverage can facilitating achieving improved contact pressure and increasing surface contact area between the C-shaped cold tube and the beverage can to increase thermal transfer from the contents of the beverage can.

15. The beverage can cooler of claim 14 further wherein the means for applying an expanding force comprises a prying mechanism.

16. The beverage can cooler of claim 15 further wherein the prying mechanism is selected from the group consisting of a lever, a wedge, a cam, and combinations thereof.

* * * * *